US009745729B2

(12) United States Patent
Yamasaki et al.

(10) Patent No.: US 9,745,729 B2
(45) Date of Patent: Aug. 29, 2017

(54) FLUSH WATER TANK ASSEMBLY, AND FLUSH TOILET WITH FLUSH WATER TANK ASSEMBLY

(71) Applicant: TOTO LTD., Fukuoka (JP)

(72) Inventors: Atsuko Yamasaki, Kitakyushu (JP); Yukinori Kubozono, Fukuoka (JP)

(73) Assignee: TOTO LTD., Fukuoka (JP)

( * ) Notice: Subject to any disclaimer, the term of this patent is extended or adjusted under 35 U.S.C. 154(b) by 554 days.

(21) Appl. No.: 14/229,629

(22) Filed: Mar. 28, 2014

(65) Prior Publication Data

US 2014/0289945 A1 Oct. 2, 2014

(30) Foreign Application Priority Data

Mar. 29, 2013 (JP) ..... 2013-073439

(51) Int. Cl.
*E03D 1/35* (2006.01)
*E03D 1/33* (2006.01)
*E03D 1/32* (2006.01)

(52) U.S. Cl.
CPC *E03D 1/33* (2013.01); *E03D 1/32* (2013.01)

(58) Field of Classification Search
USPC ..... 4/392; 137/444
See application file for complete search history.

(56) References Cited

U.S. PATENT DOCUMENTS 6,913,035 B2 * 7/2005 Huang ..... E03D 1/32 137/425

FOREIGN PATENT DOCUMENTS

JP 2009-243053 A 10/2009

* cited by examiner

*Primary Examiner* — Lauren Crane
(74) *Attorney, Agent, or Firm* — Studebaker & Brackett PC

(57) ABSTRACT

A flush water tank assembly includes: a flush water supply device for switching between a water supplying state and a water stopping state with respect of an inside of the water storage tank in terms of flush water; a small tank attached to the flush water supply device and configured to hold therein flush water; an openable and closable valve for opening and closing an opening in the bottom wall of the small tank; a float movable upwardly and downwardly according to change in water level within the small tank; and a water discharge valve device for opening and closing a water discharge port of the water storage tank, and the openable and closable valve has an auxiliary float element configured to be moved upwardly and downwardly according to change in water level within the small tank.

5 Claims, 17 Drawing Sheets

FLUSH WATER TANK ASSEMBLY, AND FLUSH TOILET WITH FLUSH WATER TANK ASSEMBLY

TECHNICAL FIELD

The present invention relates to a flush water tank assembly, and a flush toilet equipped with the flush water tank assembly, and, more particularly, to a flush water tank assembly for supplying flush water to a toilet main unit, and a flush toilet equipped with the flush water tank assembly.

BACKGROUND ART

Heretofore, as a flush water tank assembly for supplying flush water to a toilet main unit, there has been known one type which comprises a small tank formed in a tub-like shape having a bottom wall with an opening, and a float provided inside the small tank, wherein the float is adapted, when flush water held in the small tank is drained from the opening with an openable and closable valve (check valve), to be lowered along with a lowering of a water level within the small tank, causing a water supply valve to be opened interlockingly with the float, as described, for example, in the Patent Document 1.

In this type of conventional flush water supply device, in order to reduce an amount of flush water that is supplied, when the water supply valve is opened, into the flush water tank and discharged to the toilet main unit together with flush water preliminarily stored in the flush water tank (so-called "tail flushing water") during the time after a water discharge valve is opened and a water level inside the flush water tank starts lowering until the water discharge valve is closed, a valve opening time adjuster is provided which is capable of adjusting a water supply valve opening time for supplying flush water into the tank by opening the water supply valve, thereby to cause the time when the water supply valve is opened to be delayed.

PRIOR ART DOCUMENT

Patent Document

Patent Document 1: JP 2009-243053A

SUMMARY OF THE INVENTION

Technical Problem

However, with a recent increasing need for water-saving, an amount of water to be reserved in the tank has become reduced, so that a difference in distance between a dead water level (DWL) and the bottom wall of the small tank has become small. This causes a problem that, before water within the small tank has completely been drained from the opening, the water level within the flush water tank is raised by water supplied through the water supply valve and reaches the bottom wall of the small tank to cause the openable and closable valve (check valve) to close the opening in the bottom wall of the small tank, so that water remains inside the small tank. Further, if the water remains inside the small tank in this way, a problem also comes up that air inside a float cannot be replaced and the float cannot obtain sufficient buoyancy from the next flushing onward, so that the flush water tank assembly becomes malfunctioning.

The present invention has been made to solve the problems in the above conventional technique, and an object thereof is to provide a flush water tank assembly and a flush toilet equipped with the flush water tank assembly, wherein the flush water tank assembly is capable of, even if an amount of flush water to be stored in the flush water tank and supplied to the toilet main unit is reduced according to the need for water-saving, reducing the tail flushing water and replacing the air inside the float to operate the float in a normal way.

Solution to Problem

In order to achieve the object, according to a first aspect of the present invention, there is provided a flush water tank assembly for supplying flush water to a toilet main body. The flush water tank assembly comprises: a flush water tank storing therein flush water to be supplied to the toilet main unit and having a water discharge port provided in a bottom wall thereof; a water supply unit which includes a water supply pipe having an upstream end connected to a water supply source outside the flush water tank, and a water supply valve for switching between a water supplying state and a water stopping state with respect of an inside of the flush water tank, in terms of flush water supplied from the water supply pipe; a water compartment attached to the water supply unit and configured to hold therein flush water; an openable and closable valve for opening and closing an opening formed in a lateral wall or a bottom wall of the water compartment; a float provided inside the water compartment in such a manner to define therein an internal space for generating buoyancy and become movable upwardly and downwardly according to change in water level within the water compartment, and configured such that, when the water compartment is in an empty state, air is reversibly replaceable between the internal space and a space outside the water compartment; a swingable member having one end connected to the float and the other end connected to the water supply valve of the water supply unit, the swingable member being configured to open and close the water supply valve according to the upward and downward movements of the float; a water discharge valve provided to operatively open and close the water discharge port of the flush water tank, in such a manner as to, when it opens the water discharge port, cause flush water in the flush water tank to be discharged to the toilet main unit, and, when it closes the water discharge port, cause flush water to be stored in the flush water tank; and drainable water increasing means including an auxiliary float element configured to be moved upwardly and downwardly according to change in water level within the water compartment to thereby cause the openable and closable valve to be opened and closed, the drainable water increasing means being capable of, after the water level within the water compartment passes through a water level position at a time when or after the water discharge valve closes the water discharge port, increasing a speed of lowering of the water level within the water compartment to thereby increase a flow rate of flush water drainable from the opening of the water compartment into the flush water tank.

In the flush water tank assembly of the present invention, the drainable water increasing means is configured, after the water level within the water compartment passes through a water level position at a time when or after the water discharge valve closes the water discharge port of the flush water tank, to increase a speed of lowering of the water level within the water compartment to thereby increase a flow rate of flush water drainable from the opening of the water compartment into the flush water tank. This means that a speed of lowering of the water level within the water compartment and of the auxiliary float element can be made relatively slow from when the water discharge port of the flush water tank is opened by the water discharge valve until when the water discharge port is closed. Therefore, the float can also be lowered at a slow speed along with the lowering of the water level within the water compartment. This makes it possible to delay a timing for the water supply valve to be opened through the swingable member to start water supply to inside the flush water tank. Thus, it becomes possible to reduce wasteful water that is supplied through the water supply valve into the flush water tank and discharged to the toilet main unit together with flush water preliminarily stored in the flush water tank (so-called "tail flushing water"). Further, after the water level within the water compartment passes through a water level position at a time when or after the water discharge valve closes the water discharge port of the flush water tank, the drainable water increasing means can facilitate increase in a speed of lowering of the water level, float, and auxiliary float element within the water compartment, so that flush water within the water compartment can be drained in a short period of time to achieve an empty state of the water compartment. Consequently, air can be reversibly replaced between the internal space for generating buoyancy of the float and a space outside the float, so that when flush water is subsequently supplied into the water compartment to cause the float to be moved upwardly to perform water stopping operation of the water supply valve, buoyancy can be generated so as to normally operate the float. Therefore, even if an amount of flush water to be stored in the flush water tank and supplied to the toilet main unit is reduced according to the need for water-saving, it becomes possible to reduce the tail flushing water and replace the air inside the float to operate the float in a normal way.

Preferably, in the flush water tank assembly of the present invention, the drainable water increasing means is capable of causing an opening area of the opening of the water compartment in a course of opening or closing the opening by the openable and closable valve to be changed to thereby increase the flow rate of flush water drainable from the opening of the water compartment into the flush water tank.

According to this feature, an opening area of the opening of the water compartment in a course of opening or closing the opening by the openable and closable valve can be changed as drainable water increasing means to thereby change the flow rate of flush water drainable from the opening of the water compartment into the flush water tank, so that it becomes possible to reduce the "tail flushing water" with a simple structure from when the water discharge port of the flush water tank is opened by the water discharge valve until when the water discharge port is closed.

Further, after the water level within the water compartment passes through a water level position at a time when or after the water discharge valve closes the water discharge port of the flush water tank, the drainable water increasing means can facilitate increase in a speed of lowering of the water level, float, and auxiliary float element within the water compartment to cause flush water within the water compartment to be drained in a short period of time to achieve an empty state of the water compartment, so that air can be reversibly replaced between the internal space for generating buoyancy of the float and a space outside the float. Thus, when flush water is supplied into the water compartment to cause the float to be moved upwardly to perform water stopping operation of the water supply valve, buoyancy can be generated so as to normally operate the float.

As a result, even if an amount of flush water to be stored in the flush water tank and supplied to the toilet main unit is reduced according to the need for water-saving, it becomes possible to reduce the tail flushing water and replace the air inside the float to operate the float in a normal way.

Preferably, in the flush water tank assembly of the present invention, the opening of the water compartment is a single opening formed in the bottom wall of the water compartment, and the drainable water increasing means includes the single opening in the bottom wall of the water compartment, the openable and closable valve configured to open and close the single opening, and the auxiliary float element provided on the openable and closable valve. The openable and closable valve includes: a buoyancy generating portion for generating buoyancy based on flush water in the flush water tank; a valve portion for opening and closing the single opening; and a support portion extending upwardly from the valve portion and having an upper end provided with the auxiliary float element, the support portion having a large diameter segment extending upwardly from the valve portion and insertable into the single opening, and a small diameter segment extending upwardly from the large diameter segment and insertable into the single opening, the small diameter segment having a cross-section less than that of the large diameter segment, whereby the opening area of the single opening can be changed when the large diameter segment and the small diameter segment of the support portion are moved upwardly and downwardly.

In the flush water tank assembly of the present invention, the drainable water increasing means includes: the single opening in the bottom wall of the water compartment; the openable and closable valve configured to open and close the single opening; and the auxiliary float element provided on the openable and closable valve, and the support portion extending upwardly from the valve portion of the openable and closable valve has the large diameter segment and the small diameter segment insertable into the single opening in the bottom wall of the water compartment, whereby the opening area of the single opening in the bottom wall of the water compartment can be changed when the large diameter segment and the small diameter segment of the support portion are moved upwardly and downwardly. This makes it possible to facilitate change in a flow rate of flush water drainable from the single opening of the water compartment into the flush water tank according to the upward and downward movement of the large diameter segment and the small diameter segment. In particular, from when the water discharge port of the flush water tank is opened by the water discharge valve until when the water discharge port is closed, the openable and closable valve is in either of the following two states: where buoyancy is generated at the buoyancy generating portion of the openable and closable valve based on flush water in the flush water tank, and the valve portion of the openable and closable valve is moved upwardly to close the single opening in the bottom wall of the water compartment; or where buoyancy is not generated at the buoyancy generating portion of the openable and closable valve based on flush water in the flush water tank, and is generated at the auxiliary float element based on flush water in the water compartment. Thus, even when the valve portion of the openable and closable valve opens the single opening in the bottom wall of the water compartment, flush water in the water compartment is drained into the flush water tank through a relatively small opening area formed between the large diameter segment of the support portion of the openable and closable valve and the single opening of the water compartment. Therefore, a speed of lowering of the water level within the water compartment and of the auxiliary float element can be made relatively slow. This makes it possible to reduce the "tail flushing water" with a simple structure of the openable and closable valve from when the water discharge port of the flush water tank is opened by the water discharge valve until when the water discharge port is closed. Further, after the water level within the water compartment passes through a water level position at a time when or after the water discharge valve closes the water discharge port, buoyancy is generated at the auxiliary float element based on flush water in the water compartment. In this state, flush water in the water compartment is drained into the flush water tank through a relatively large opening area formed between the small diameter segment of the support portion of the openable and closable valve and the single opening of the water compartment. Thus, a speed of lowering of the water level in the water compartment and of the auxiliary float element can be increased, so that flush water within the water compartment can be drained in a short period of time to achieve an empty state of the water compartment. Consequently, air can be reversibly replaced between the internal space for generating buoyancy of the float and a space outside the float, so that when flush water is subsequently supplied to inside the water compartment to cause the float to be moved upwardly to perform water stopping operation of the water supply valve, buoyancy can be generated so as to normally operate the float. As a result, even if an amount of flush water to be stored in the flush water tank and supplied to the toilet main unit is reduced according to the need for water-saving, it becomes possible to reduce the tail flushing water and replace the air inside the float to operate the float in a normal way.

Preferably, in the flush water tank assembly of the present invention, the opening of the water compartment includes a first opening formed in a lateral wall or a bottom wall of the water compartment, and a second opening formed in the bottom wall of the water compartment, in addition to the first opening; the openable and closable valve includes a first openable and closable valve for opening and closing the first opening, and a second openable and closable valve for opening and closing the second opening, and the drainable water increasing means includes the second opening, the second openable and closable valve, and the auxiliary float element provided on the second openable and closable valve, and wherein the second openable and closable valve includes a valve portion for opening and closing the second opening, and a support portion extending upwardly from the valve portion and insertable into the second opening, and wherein the auxiliary float element is provided on an upper end of the support portion, the auxiliary float element being configured such that, after the water level within the water compartment passes through a water level position at a time when or after the water discharge valve closes the water discharge port, it is lowered by losing its buoyancy.

According to this feature, the drainable water increasing means includes the second opening, the second openable and closable valve, and the auxiliary float element provided on the second openable and closable valve, and the second openable and closable valve includes a valve portion for opening and closing the second opening, and a support portion extending upwardly from the valve portion and insertable into the second opening, and the auxiliary float element provided on an upper end of the support portion, whereby a total opening area of the first and second openings of the water compartment can be changed when each of the first and second openable and closable valves is moved upwardly and downwardly to open and close the respective opening. This makes it possible to facilitate change in a flow rate of flush water drainable from the first and second openings of the water compartment into the flush water tank. In particular, from when the water discharge port of the flush water tank is opened by the water discharge valve until when the water discharge port is closed, the openable and closable valves are in either of the following two states: where each of the first and second openable and closable valves closes respective one of the first and second openings based on flush water in the flush water tank; or where the first openable and closable valve opens the first opening based on flush water in the flush water tank, and buoyancy is generated at the auxiliary float element of the second openable and closable valve based on flush water in the water compartment to cause the second openable and closable valve to close the second opening. Thus, flush water in the water compartment is only drained from the first opening opened by the first openable and closable valve through a relatively small opening area. Therefore, a speed of lowering of the water level within the water compartment and of the auxiliary float element can be made relatively slow. This makes it possible to reduce the "tail flushing water" with a simple structure from when the water discharge port of the flush water tank is opened by the water discharge valve until when the water discharge port is closed. Subsequently, after the water level within the water compartment passes through a water level position at a time when or after the water discharge valve closes the water discharge port, and when buoyancy is generated at the auxiliary float element of the second openable and closable valve based on flush water in the water compartment, flush water in the water compartment is drained into the flush water tank from both of the first opening opened by the first openable and closable valve and the second opening opened by the second openable and closable valve through a relatively large opening area. Thus, a speed of lowering of the water level in the water compartment and of the auxiliary float element of the second openable and closable valve can be increased, so that flush water within the water compartment can be drained in a short period of time to achieve an empty state of the water compartment. Consequently, air can be reversibly replaced between the internal space for generating buoyancy of the float and a space outside the float, so that when flush water is subsequently supplied to inside the water compartment to cause the float to be moved upwardly to perform water stopping operation of the water supply valve, buoyancy can be generated so as to normally operate the float. As a result, even if an amount of flush water to be stored in the flush water tank and supplied to the toilet main unit is reduced according to the need for water-saving, it becomes possible to reduce the tail flushing water and replace the air inside the float to operate the float in a normal way.

According to a second aspect of the present invention, there is provided a flush toilet comprising the above flush water tank assembly.

The flush toilet of the present invention may comprise a flush water tank assembly that can reduce the tail flushing water and operate the float in a normal way even if an amount of flush water to be stored in the flush water tank and supplied to the toilet main unit is reduced according to the need for water-saving.

Advantageous Effect of Invention

The flush water tank assembly of the present invention can, even if an amount of flush water to be stored in the flush water tank and supplied to the toilet main unit is reduced according to the need for water-saving, reduce the tail flushing and replace the air inside the float to operate the float in a normal way.

DESCRIPTION OF EMBODIMENTS

With reference to the accompanying drawings, a flush water tank assembly according to a first embodiment of the present invention and a flush toilet equipped with the flush water tank assembly will now be described.

First of all, based on FIG. 1, a flush toilet using a flush water tank assembly according to the first embodiment of the present invention will be described below.

Figure 1:
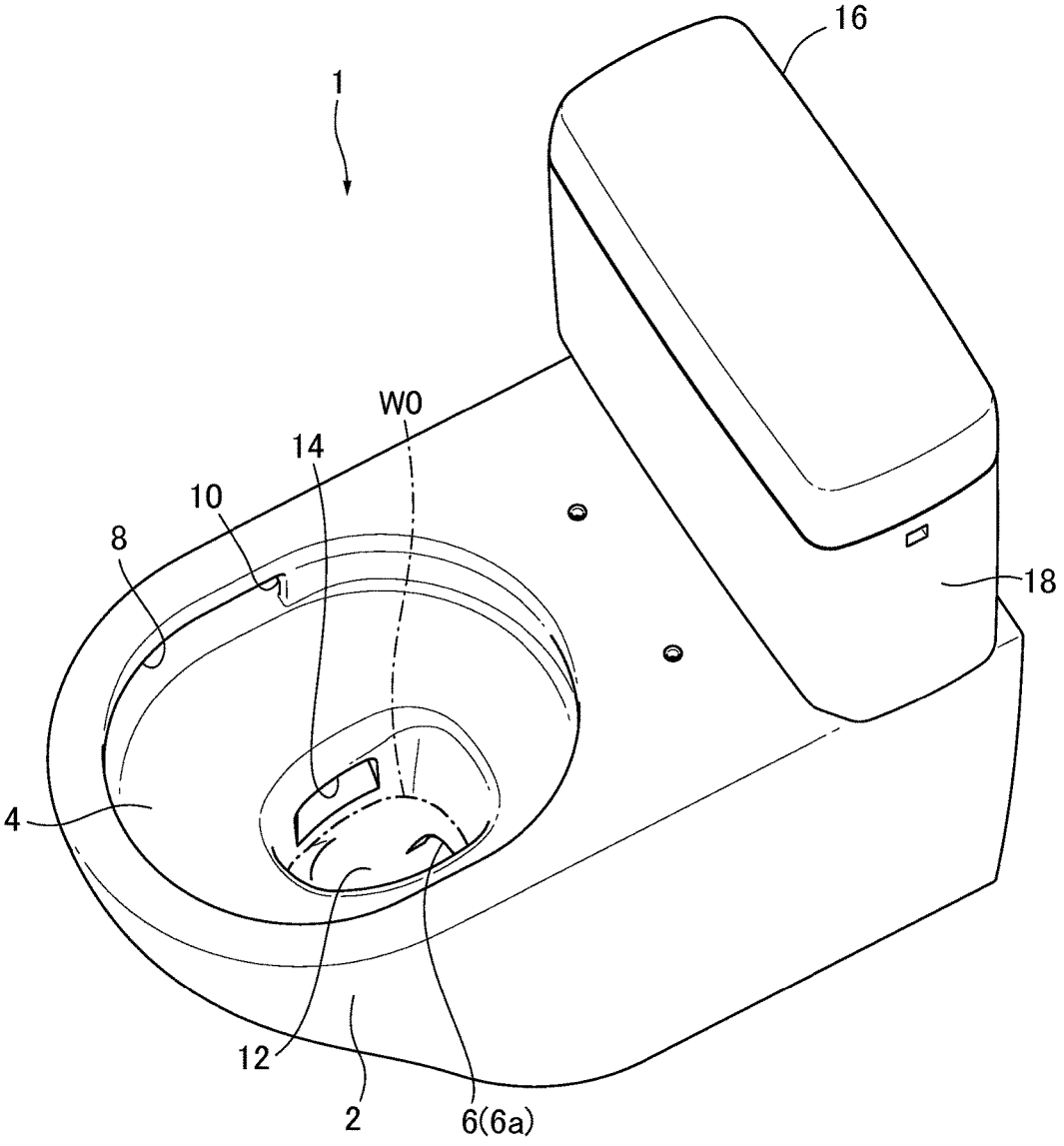
FIG. 1 is a perspective view illustrating a flush toilet using a flush water tank assembly according to a first embodiment of the present invention, wherein a toilet seat and a toilet cover are removed therefrom.

FIG. 1 is a perspective view illustrating a flush toilet using a flush water tank assembly according to the first embodiment of the present invention, wherein a toilet seat and a toilet cover are removed therefrom.

As illustrated in FIG. 1, the reference numeral 1 indicates a so-called siphon-type flush toilet designed to suck waste in a bowl portion and discharge the waste from a drainage trap passage to the outside at once, by means of a siphon action. The flush toilet 1 includes a toilet main unit 2 made of porcelain. The toilet main unit 2 is formed with a bowl portion 4, and a drainage trap passage 6 communicated with a bottom of the bowl portion 4.

The bowl portion 4 of the toilet main unit 2 has an upper edge formed with an inwardly overhanging rim 8, and a first spout port 10 for spouting flush water supplied from a water conduit (not illustrated) formed inside a rear of the toilet main unit 2. Specifically, the toilet main unit 2 is configured to allow flush water spouted from the first spout port 10 to spirally whirling downwardly along an inner surface thereof to thereby flush the bowl portion 4.

The bowl portion 4 has a lower region formed as a water pooling region 12 capable of pooling water up to a water level (pooled-water level) indicated by the one-dot chain line W0. An inlet 6*a* of the drainage trap passage 6 is opened at a bottom of the water pooling region 12, and an outlet of the drainage trap passage 6 located rearward of the inlet 6*a* is connected to a drain pipe (not illustrated) arranged under a floor, via a drain socket (not illustrated).

The bowl portion 4 further has a second spout port 14 formed at a position above the pooled-water level W0 to spout flush water supplied from the water conduit (not illustrated) formed inside the rear of the toilet main unit 2. Specifically, the toilet main unit 2 is configured to allow flush water spouted from the second spout port 14 to cause water pooled in the water pooling region 12 to have a flow whirling in an up-down direction.

A flush water tank assembly 16 according to the first embodiment of the present invention is provided on an upper surface of the rear of the toilet main unit 2 to store flush water to be supplied to the toilet main unit 2.

Although the first embodiment will be described based on an example in which the flush water tank assembly 16 is applied to the above siphon-type flush toilet, a scope of application of the present invention is not limited to the siphon-type flush toilet, but the present invention can also be applied to any other type of flush toilet, such as a so-called wash down-type flush toilet designed to wash away waste by means of a water flow action caused by water head within the bowl portion.

Secondly, based on FIG. 2, an internal structure of the flush water tank assembly 16 according to the first embodiment of the present invention will be described below.

Figure 2:
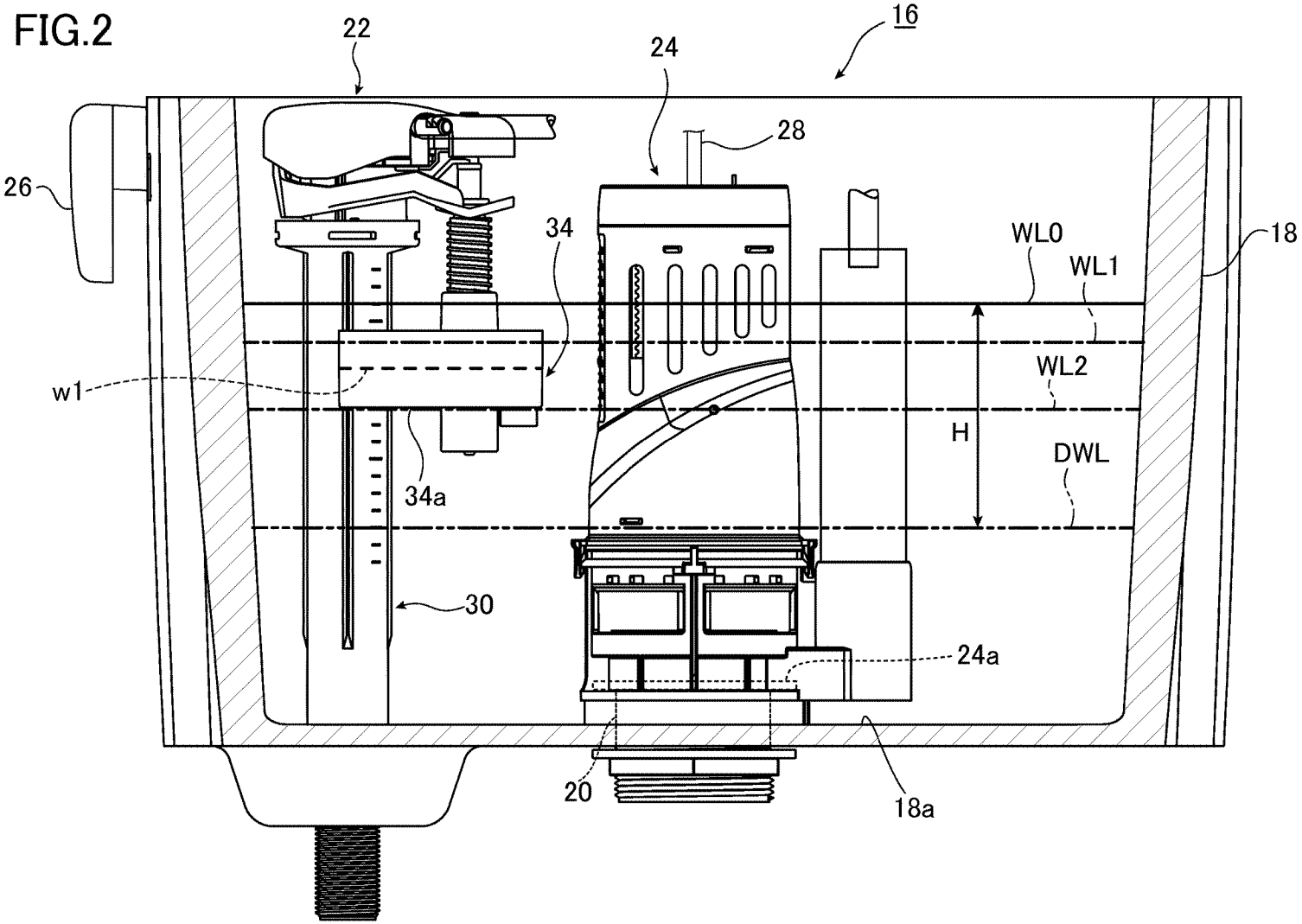
FIG. 2 is a front sectional view illustrating an internal structure of the flush water tank assembly according to the first embodiment of the present invention.

FIG. 2 is a front sectional view illustrating the internal structure of the flush water tank assembly according to the first embodiment of the present invention. In FIG. 2, a maximum water level, a water-stopping water level and a dead water level within an aftermentioned water storage tank 18 are designated by WL0, WL1 and DWL, respectively. Further, a water level within the water storage tank and a water level within an aftermentioned small tank, causing start of water supply through the flush water supply device of the flush water tank assembly, are designated by WL2 and w1, respectively.

As illustrated in FIGS. 1 and 2, the flush water tank assembly 16 includes a water storage tank 18 for storing therein flush water for flushing the flush toilet 1. The water storage tank 18 has a bottom wall 18*a* formed with a water discharge port 20 which is communicated with the water conduit (not illustrated) of the toilet main unit 2 in such a manner as to allow flush water in the water storage tank 18 to be supplied to the water conduit (not illustrated) of the toilet main unit 2. It is to be understood that an amount of flush water to be stored in the water storage tank 18 varies depending on types of toilets.

As illustrated in FIG. 2, the flush water tank assembly 16 further includes a flush water supply device 22 and a water discharge valve device 24 each provided inside the water storage tank 18, wherein the flush water supply device 22 is designed to supply flush water into the water storage tank 18, and the water discharge valve device 24 is designed to open the water discharge port 20 so as to cause flush water stored in the water storage tank 18 to flow into the water conduit (not illustrated) of the toilet main unit 2.

The water discharge valve device 24 has the same configuration as that of a conventional water discharge valve device. Specifically, although not described in detail, the water discharge valve device 24 is configured such that, when a manual operation lever 26 attached to an outer side of the water storage tank 18 is manually turned in a direction for causing a given flushing mode (a large flushing mode or a small flushing mode) to be performed, a valve element 24*a* thereof is pulled upwardly by a control wire 28 interlockingly coupled to the manual operation lever 26, and thereby the water discharge port 20 is opened for a given period of time to allow a certain amount of flush water in the water storage tank 18 to be discharged to the water conduit (not illustrated) of the toilet main unit 2.

Thirdly, with reference to FIGS. 2 to 5, details of the flush water supply device in the flush water tank assembly according to the first embodiment of the present invention will be described below.

Figure 3:
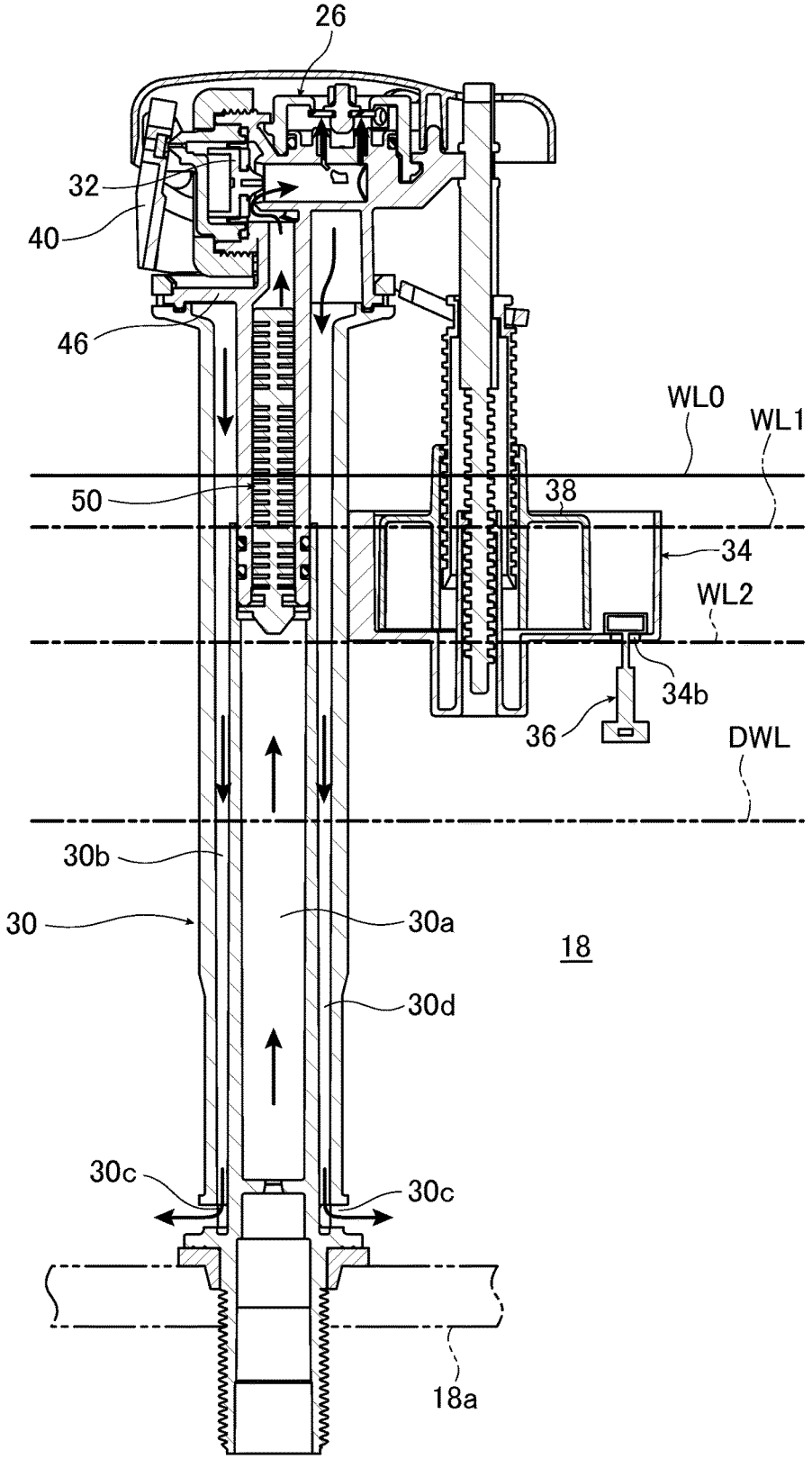
FIG. 3 is a front sectional view illustrating the flush water tank assembly according to the first embodiment of the present invention.
Figure 4:
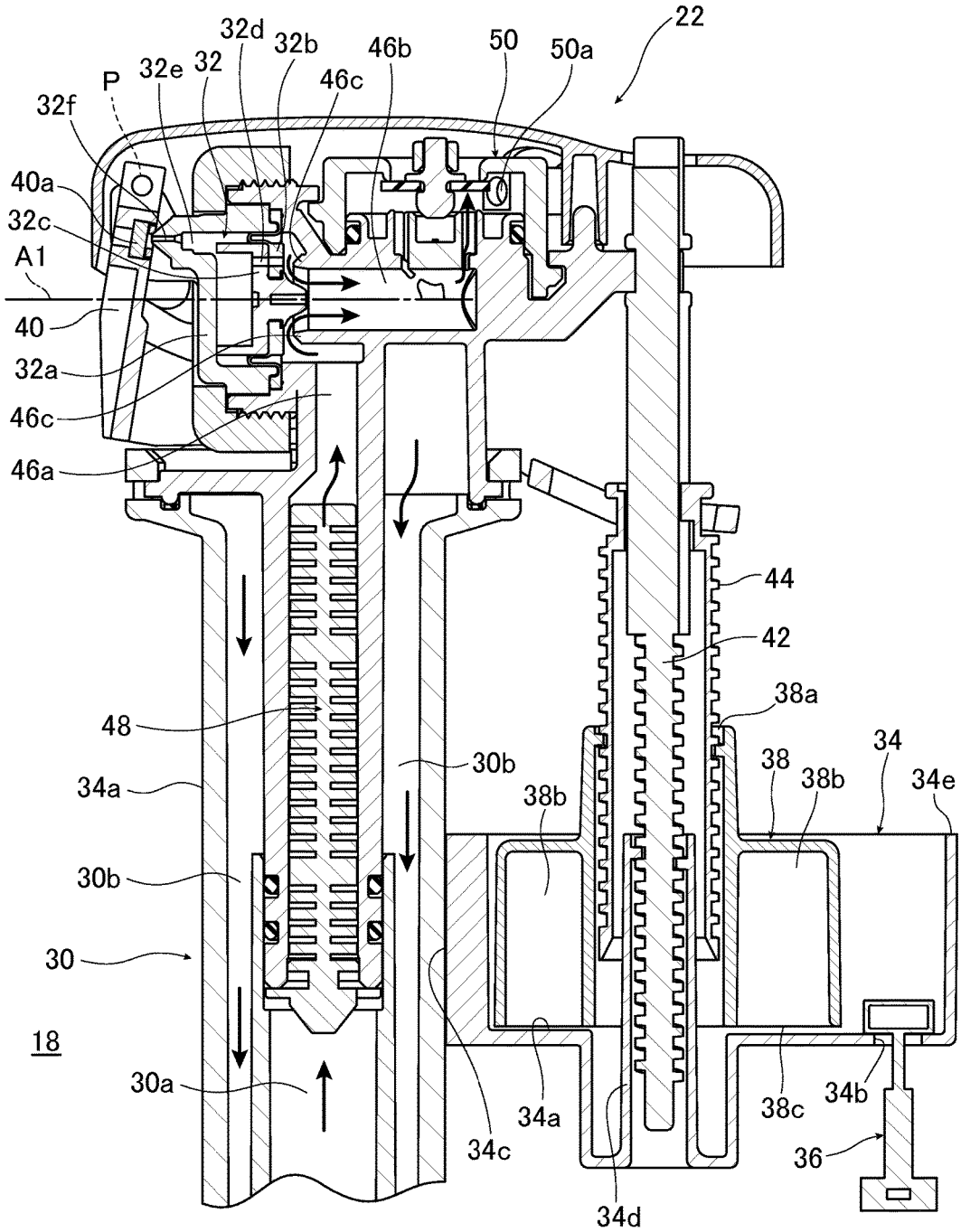
FIG. 4 is a fragmentary enlarged sectional view enlargedly illustrating a part of the flush water supply device in the flush water tank assembly according to the first embodiment of the present invention, in a water supplying state (valve open state).
Figure 5:
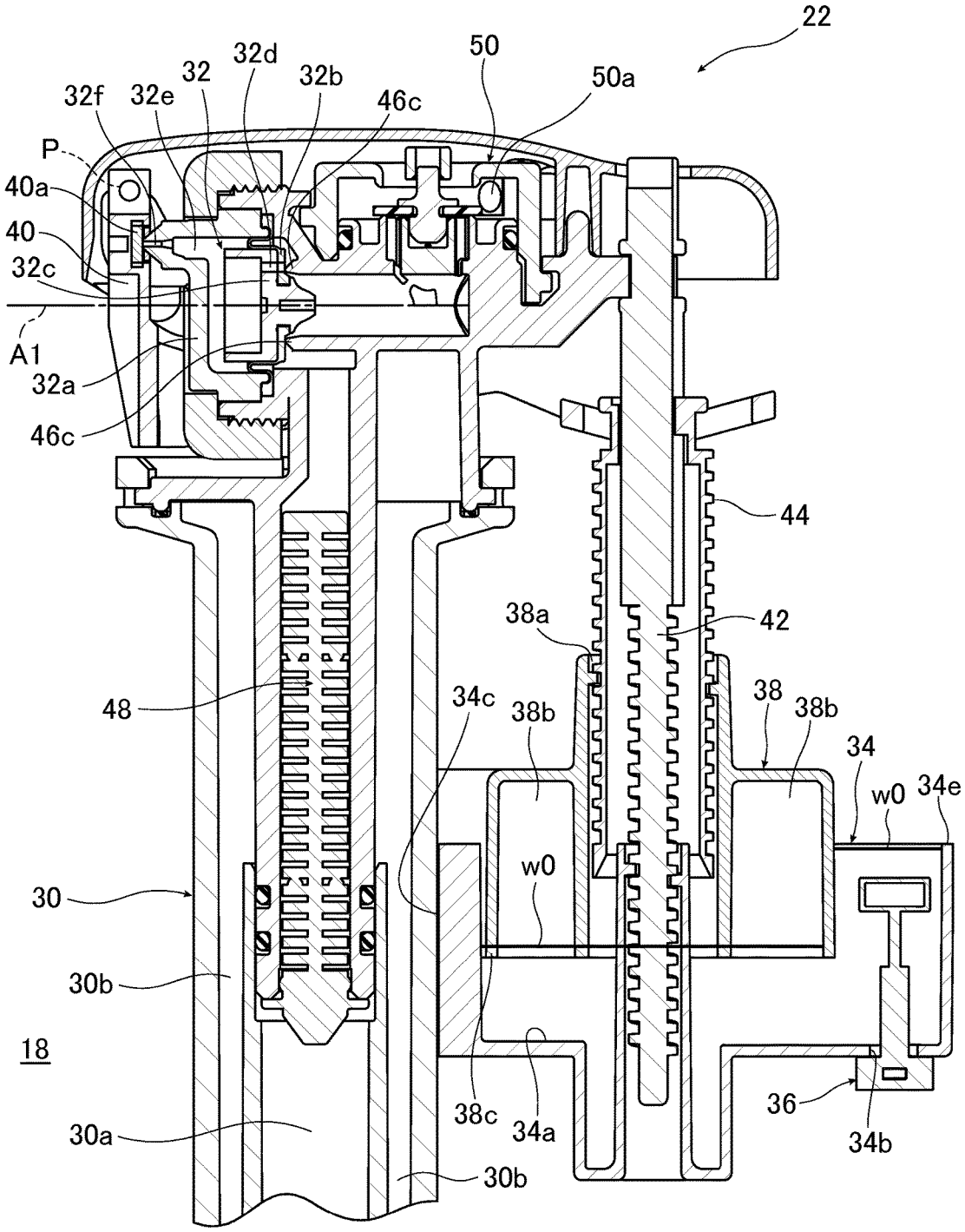
FIG. 5 is a fragmentary enlarged sectional view enlargedly illustrating a part of the flush water supply device in the flush water tank assembly according to the first embodiment of the present invention, in a water stopping state (valve closed state).

FIG. 3 is a front sectional view illustrating the flush water tank assembly according to the first embodiment of the present invention. FIG. 4 is a fragmentary enlarged sectional view enlargedly illustrating a part of the flush water supply device in the flush water tank assembly according to the first embodiment of the present invention, in a water supplying state (valve open state). FIG. 5 is a fragmentary enlarged sectional view enlargedly illustrating a part of the flush water supply device in the flush water tank assembly according to the first embodiment of the present invention, in a water stopping state (valve closed state). In FIGS. 3 and 4, water flows in a primary water supply passage and a secondary water supply passage are indicated by the arrowed lines.

As illustrated in FIGS. 2 to 5, the flush water supply device 22 includes a water supply pipe 30 connected to a water supply source (not illustrated) outside the water storage tank 18 and extending upwardly from a bottom wall 18*a* of the water storage tank 18, and a diaphragm-operated water supply valve 32 provided above and in laterally offset relation to the water supply pipe 30 and adapted to switch between a water spouting state and a water stopping state with respect to an inside of the water storage tank 18, in terms of flush water supplied from the water supply pipe 30.

The flush water supply device 22 further includes a small tank 34 detachably attached to the water supply pipe 30. The small tank 34 has a single opening 34*b* formed in a bottom wall 34*a* thereof to penetrate therethrough in an up-down direction. Attached to the opening 34*b* of the small tank 34 is an openable and closable valve 36 that is adapted to be moved upwardly and downwardly, thereby to open and close the opening 34*b*.

The flush water supply device 22 further includes a float 38 provided inside the small tank 34 and adapted to be moved upwardly and downwardly according to change in water level within the small tank 34.

The flush water supply device 22 further includes a swingable member 40 having one end connected to the float 38 and the other end connected to the water supply valve 32. The swingable member 40 is adapted, according to the upward and downward movements of the float 38, to be swingably moved about a fulcrum (support point) P located adjacent to the water supply valve 32, thereby to cause opening and closing of the water supply valve 32.

Furthermore, the flush water supply device 22 includes: a small tank position-adjusting fixed shaft member 42 fixed above and in laterally offset relation to the water supply pipe 30 and capable of adjusting a position of the small tank 34 with respect to the water supply pipe 30 in an up-down direction, and an adjustment shaft member 44 attached to a distal end of the swingable member 40 and the float 38 so as to connect them together and screwed into a mounting hole 38*a* formed in an approximately central region of the float 38, in a manner capable of adjusting a vertical relative position between the distal end of the swingable member 40 and the float 38.

As illustrated in FIGS. 2 to 5, the water supply pipe 30 is attached to the bottom wall 18*a* of the water storage tank 18, and connected to an external water supply source (not illustrated), such as a waterworks system, to supply flush water into the water storage tank 18. The water supply pipe 30 has a primary water supply passage 30*a* formed in a central region thereof to extend in an up-down direction, a secondary water supply passage 30*b* formed thereinside and outward of the primary water supply passage 30*a*, and an outlet port 30*c* formed at a lower end of the secondary water supply passage 30*b* to allow flush water to be supplied into the water storage tank 18 therethrough.

As illustrated in FIGS. 3 to 5, a water supply passage-forming member 46 having an internal passage forming a water supply passage is provided at an upper end of the water supply pipe 30. The water supply passage-forming member 46 has a primary water supply passage 46*a* formed in a central region of a portion thereof inserted into the water supply pipe 30 to extend in the up-down direction, and connected to the primary water supply passage 30*a* of the water supply pipe 30.

Further, a filter member 48 is installed inside the primary water supply passage 46*a* of the water supply passage-forming member 46 to subject water to filtering.

Further, the water supply passage-forming member 46 has a secondary water supply passage 46*b* formed inside a portion thereof located above the water supply pipe 30 to have a central axis A1 extending in a horizontal direction and a downstream end communicated with the secondary water supply passage 30*b* of the water supply pipe 30.

The diaphragm-operated water supply valve 32 is provided to be interposed between the primary water supply passage 46*a* and the secondary water supply passage 46*b* of the water supply passage-forming member 46 extending in the up-down direction and in the horizontal direction, respectively.

As illustrated in FIGS. 4 and 5, the water supply valve 32 includes: a valve housing 32*a* having a central axis aligned with the central axis A1 extending in the horizontal direction; a diaphragm 32*b* attached to the valve housing 32*a* concentrically with respect to the central axis A1 and adapted to be displaceable along the central axis A1 in a right-left direction (in FIGS. 4 and 5); and a valve element 32*c* attached to the diaphragm 32*b* and adapted to be displaceable in the right-left direction in FIGS. 4 and 5 integrally together with the diaphragm 32*b*.

The diaphragm 32*b* is formed with a bleed hole 32*d* extending parallel to the central axis A1. Through the bleed hole 32*d*, the primary water supply passage 46*a* of the water supply passage-forming member 46 and a back pressure chamber 32*e* located on a lateral side with respect to the diaphragm 32*b* are communicated with each other. A portion of the valve housing 32*a* located laterally beside the back pressure chamber 32*e* is formed with a pilot hole 32*f*.

As illustrated in FIGS. 4 and 5, the swingable member 40 is attached to a lateral side of the valve housing 32*a* of the water supply valve 32, swingably about the fulcrum P located at an end of the valve housing 32*a*. The swingable member 40 includes a valve member 40*a* for opening and closing the pilot hole 32*f* of the water supply valve 32 according to the swinging movement. Specifically, the valve member 40*a* of the swingable member 40 is adapted to open and close the pilot hole 32*f* of the water supply valve 32, thereby making it possible to switch between the water supplying state and the water stopping state according to the water supply valve 32.

FIG. 4 illustrates a state (water supplying state) in which, when a water level within the small tank 34 becomes approximately zero, the float 38 is moved downwardly to a lowermost position to cause the swingable member 40 to be swingingly moved downwardly about the fulcrum P, so that the valve member 40*a* is moved to open the pilot hole 32*f* of the water supply valve 32, and thereby the valve element 32*c* is displaced leftwardly (in FIG. 5) to open a valve seat 46*c* of the water supply passage-forming member 46 located at an upstream end of the secondary water supply passage 46*b*.

On the other hand, FIG. 5 illustrates a state (water stopping state) in which the float 38 is moved upwardly to an uppermost position to cause the swingable member 40 to be swingingly moved upwardly about the fulcrum P, so that the valve member 40*a* is moved to close the pilot hole 32*f* of the water supply valve 32, and thereby the valve element 32*c* is displaced rightwardly (in FIG. 5) to close the valve seat 46*c* of the water supply passage-forming member 46 located at the upstream end of the secondary water supply passage 46*b*.

As illustrated in FIGS. 4 and 5, a supplementary water system 50 is provided above the secondary water supply passage 46*b* of the water supply passage-forming member 46 extending in the horizontal direction. The supplementary water system 50 has a lateral wall formed with a supplementary water supply passage 50*a* for separating a part of water flowing from the secondary water supply passage 46*b* of the water supply passage-forming member 46 into the housing 50, as supplementary water, and refilling the supplementary water into the water storage tank 18.

Next, with reference to FIGS. 4 and 5, the small tank 34 and the float 38 will be described in more detail below.

As illustrated in FIGS. 4 and 5, the small tank 34 is formed in a generally horizontally-long flattened shape in which a maximum vertical length becomes less than a maximum horizontal (longitudinal) length.

The small tank 34 has a water-supply-pipe attaching portion 34*c* adapted to be detachably attached to a lateral side of a water supply pipe 30 fixedly attached to a water storage tank 18, and a fixing portion 34*d* formed to extend from an approximately central region of a bottom wall 34*a* thereof in an up-down direction, and adapted to allow a portion of a fixed shaft member 42 to be inserted thereinto and threadingly engaged therewith, thereby fixing a position of the small tank 34 in the up-down direction. In this case, a plurality of types of small tanks each having a different capacity to receive therein flush water may be prepared, so that one of the small tanks 34 can be appropriately replaced with another one suitable for an amount of flush water in the water storage tank 18 to be used for toilet flushing.

The float 38 is made of a resin material, and formed to have an outer peripheral shape approximately conforming to an internal shape of the small tank 34 in a manner capable of being received inside the small tank 34.

Further, as illustrated in FIGS. 3 to 5, the float 38 has a shape opened only downwardly, and has, within an internal space thereof, a buoyancy generating portion 38*b* for generating buoyancy based on air within the internal space and flush water within the small tank 34.

Furthermore, the float 38 is adapted to be movable upwardly and downwardly according to change in water level within the small tank 34. When the small tank 34 is in an empty state as illustrated in FIG. 4, air is reversibly replaceable between the internal space of the buoyancy generating portion 38*b* and a space outside the float 38 via e.g., a gap between a lower end 38*c* of the float 38 and the bottom wall 34*a* of the small tank 34.

In FIG. 5, a water level within the small tank 34 and the float 38 when the float 38 is moved upwardly during the water stopping state, and located at a position where a balance between a self-weight of the float 38 and buoyancy based on flush water in the small tank 34 is achieved is designated by the code w0. At this position, although air is held in the internal space (buoyancy generating portion 38*b*) of the float 38, and the flush water in the small tank 34 scarcely flows into the internal space of the float 38, the water level w0 within the float 38 is located slightly above a lower end 38*c* of the float 38 due to a pressure of flush water around the lower end 38*c* of the float 38.

Further, the water level w0 within the small tank 34 and the float 38 is substantially equal to a water level at which a space within the small tank 34 other than the float 38 is substantially filled up. This water level is higher than the water level WL1 within the small tank 34 causing start of water supply through the flush water supply device 22 as illustrated in FIG. 2.

Next, with reference to FIGS. 6 and 7, details of the openable and closable valve 36 for opening and closing the opening 34*b* of the small tank 34 will be described.

Figure 6:
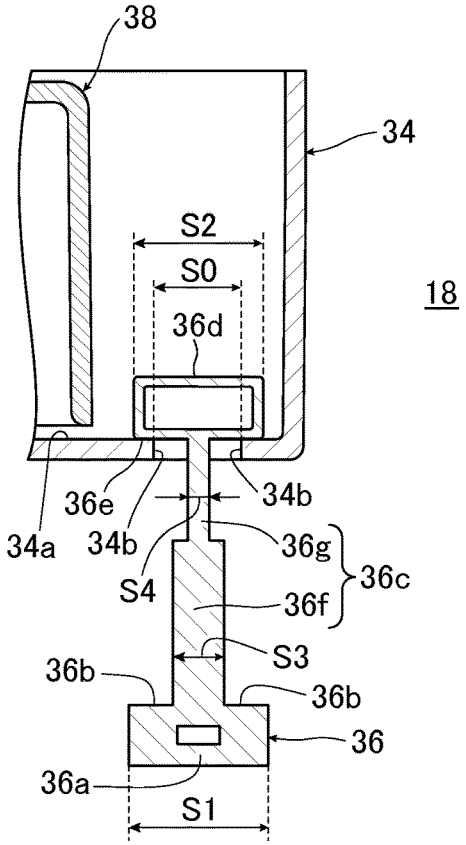
FIG. 6 is a fragmentary enlarged sectional view enlargedly illustrating a part of openable and closable valve of the flush water tank assembly illustrated in FIG. 4 according to the first embodiment of the present invention.
Figure 7:
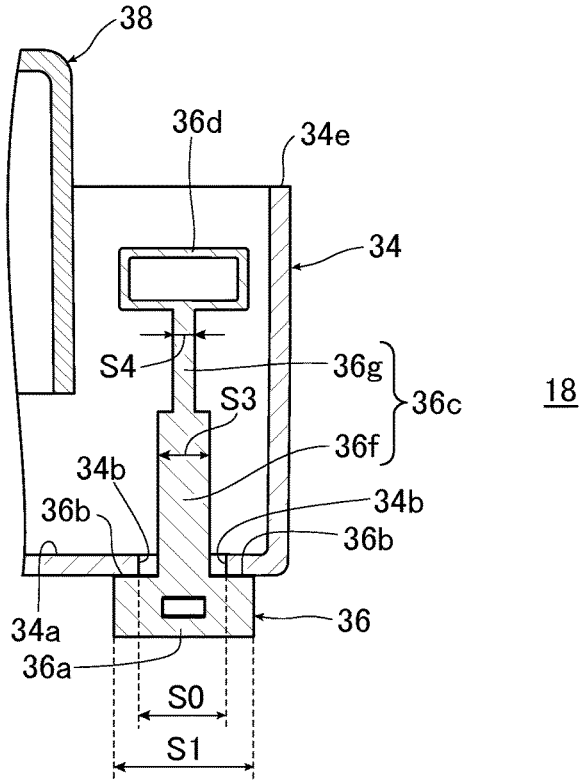
FIG. 7 is a fragmentary enlarged sectional view enlargedly illustrating a part of openable and closable valve of the flush water tank assembly illustrated in FIG. 5 according to the first embodiment of the present invention.

FIG. 6 is a fragmentary enlarged sectional view enlargedly illustrating a part of openable and closable valve of the flush water tank assembly illustrated in FIG. 4 according to the first embodiment of the present invention, and FIG. 7 is a fragmentary enlarged sectional view enlargedly illustrating a part of openable and closable valve of the flush water tank assembly illustrated in FIG. 5 according to the first embodiment of the present invention.

As illustrated in FIGS. 6 and 7, the openable and closable valve 36 for opening and closing the opening 34*b* of the small tank 34 is made of a material having a specific gravity less than that of water (e.g., a resin material), so as to become capable of being moved upwardly and downwardly depending on the flush water level within the water storage tank 18. The openable and closable valve 36 is inserted into the opening 34*b* in the bottom wall 34*a* of the small tank 34 from therebelow and attached to the opening 34*b* in a manner capable of opening and closing the opening 34*b*, and adapted to be moved upwardly and downwardly by means of buoyancy, according to the flush water level within the water storage tank 18.

Describing more specifically a structure of the openable and closable valve 36, as illustrated in FIGS. 6 and 7, the openable and closable valve 36 includes a buoyancy generating portion 36*a* provided at a lower end thereof in such a manner as to generate buoyancy based on flush water within the water storage tank 18.

The openable and closable valve 36 further includes a generally cylindrically-shaped (disk-shaped) valve portion 36*b* having a space thereinside, that is adapted to be moved upwardly and downwardly, thereby to open and close the opening 34*b*. The valve portion 36*b* has a cross-section area 51 larger than an opening cross-section area S0 of the opening 34*b* of the small tank 34, and is adapted to, when the water level of the flush water within the water storage tank 18 is around adjacent to or higher than the bottom of the small tank 34, be moved upwardly by means of buoyancy generated in the buoyancy generating portion 36*a*, and brought into contact with a lower edge of the single opening 34*b* of the small tank 34, thereby to close the opening 34*b* (see FIG. 7). On the other hand, the valve portion 36*b* is adapted to, when the water level of the flush water within the water storage tank 18 is around adjacent to or lower than the bottom of the small tank 34, be moved downwardly below the position of the opening 34*b* in the bottom wall 34*a* of the small tank 34, thereby to open the single opening 34*b* (see FIG. 7).

Further, as illustrated in FIGS. 6 and 7, the openable and closable valve 36 includes a support portion 36*c* formed to extend upwardly from the valve portion 36*b* and having a cross-section area smaller than the opening cross-section area S0 of the opening 34*b*.

The openable and closable valve 36 further includes an auxiliary float element 36*d* provided on an upper end of the support portion 36*c* in such a manner as to be movable upwardly and downwardly according to change in water level of the flush water within the small tank 34. The auxiliary float element 36*d* is formed in a generally cylindrical shape to have a space formed thereinside and to have a cross-section area S2 larger than the opening cross-section area S0 of the opening 34*b* of the small tank 34, and is adapted to generate buoyancy based on flush water within the small tank 34. Further, as illustrated in FIG. 6, when the small tank 34 is in an empty state to cause the openable and closable valve 36 to be moved downwardly, a lower end 36*e* of the auxiliary float element 36*d* is brought contact with an upper edge of the single opening 34*b* of the small tank 34 to prevent the openable and closable valve 36 from dropping off the small tank 34.

Further, the support portion 36*c* of the openable and closable valve 36 includes a large diameter segment 36*f* extending upwardly from the valve portion 36*b* and insertable into the opening 34*b* of the small tank 34, and a small diameter segment 36*g* extending upwardly from the large diameter segment 36*f* and insertable into the opening 34*b* of the small tank 34. The small diameter segment 36*g* has a cross-section area S4 smaller than a cross-section area S3 of the large diameter segment 36*f*. According to the upward and downward movements of the large diameter segment 36*f* and the small diameter segment 36*g* of the support portion 36*c*, an opening area S5 formed between an outer peripheral surface of the large diameter segment 36*f* and a circumferential surface of the opening 34*b* of the small tank 34 when the large diameter segment 36*f* of the support portion 36*c* of the openable and closable valve 36 passes through the opening 34*b* of the small tank 34 (an area provided by subtracting the cross-section area S3 of the large diameter segment 36*f* of the openable and closable valve 36 from the opening cross-section area S0 of the opening 34*b* of the small tank 34 (S5=S0−S3)) becomes relatively small. On the other hand, an opening area S6 formed between an outer peripheral surface of the small diameter segment 36*g* and a circumferential surface of the opening 34*b* of the small tank 34 when the small diameter segment 36*g* of the support portion 36*c* of the openable and closable valve 36 passes through the opening 34*b* of the small tank 34 (an area provided by subtracting the cross-section area S4 of the small diameter segment 36*g* of the openable and closable valve 36 from the opening cross-section area S0 of the opening 34*b* of the small tank 34 (S6=S0−S4)) becomes larger than the opening area S5 between the outer peripheral surface of the large diameter segment 36*f* and the circumferential surface of the opening 34*b* of the small tank 34. That is, the opening area provided when the openable and closable valve 36 opens the opening 34*b* of the small tank 34 can be changed according to the height position of the openable and closable valve 36.

By allowing the opening area of the opening 34*b* of the small tank 34 in a course of opening or closing the opening 34*b* by the openable and closable valve 36 to be changed in this way, the flow rate of flush water drainable from the opening 34*b* of the small tank 34 into the water storage tank 18 can be increased.

In the first embodiment, the openable and closable valve 36 itself is made of a material having a specific gravity less than that of water (e.g., a resin material), and the buoyancy generating portion 36*a* of the openable and closable valve 36 is configured to form a space for holding air therein. Alternatively, the buoyancy generating portion 36*a* may be made of a material having a specific gravity less than that of water (e.g., a resin material) and formed in a solid structure while eliminating a space for holding air therein.

Further, as illustrated in FIG. 7, the openable and closable valve 36 is adapted, when the water level within the water storage tank 18 is raised, to quickly close the opening 34*b* of the small tank 34 by means of buoyancy, according to the water level within the water storage tank 18. Thus, just before the water level within the water storage tank 18 is raised beyond an upper edge 34*e* of the small tank 34 to cause flush water to flow into the small tank 34, an inside of the small tank 34 can be kept vacant to allow the float 38 to be kept at its lowermost position. Then, when flush water flows into the small tank 34 beyond the upper edge 34*e* of the small tank 34, the float 38 can be quickly moved upwardly to promptly set a water supply valve 32 to the water stopping state.

The single opening 34*b* in the bottom wall 34*a* of the small tank 34, the openable and closable valve 36 for opening and closing the opening 34*b*, and each of the portions 36*a* to 36*g* of the openable and closable valve 36 are adapted together to function as drainable water increasing means that allows a speed of lowering of the water level within the small tank 34 after the water level within the small tank 34 is lowered and passes through a position of a predetermined water level w1 after the water discharge port 20 is closed by the valve element 24*a* of the water discharge valve device 24 to be faster than that when the water discharge port 20 is opened by the valve element 24*a* of the water discharge valve device 24 to thereby increase a flow rate of flush water drainable from the opening 34*b* of the small tank 34 into the water storage tank 18.

Next, with reference to FIGS. 1 to 9, operations (functions) of the flush water tank assembly according to the first embodiment, and the flush toilet equipped with the flush water tank assembly, will be described.

Figure 8:
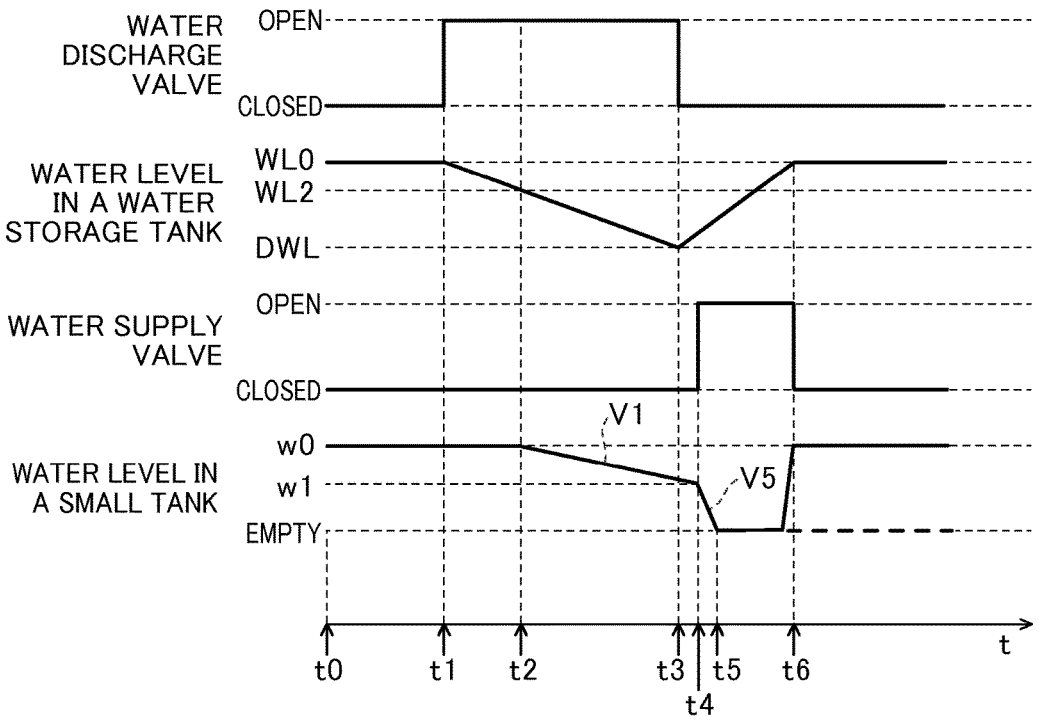
FIG. 8 is a time chart illustrating in time-series each of changes in an open or closed state of a water discharge valve of a water discharge valve device, a water level within a water storage tank, an open or closed state of a water supply valve of a flush water supply device, and a water level within a small tank in the flush water tank assembly according to the first embodiment of the present invention.

FIG. 8 is a time chart illustrating in time-series each of changes in an open or closed state of a water discharge valve of a water discharge valve device, a water level within a water storage tank, an open or closed state of a water supply valve of a flush water supply device, and a water level within a small tank in the flush water tank assembly according to the first embodiment of the present invention, and FIGS. 9*a* to 9*h* schematically illustrate operations of a float and an openable and closable valve of the flush water supply device in the flush water tank assembly according to the first embodiment of the present invention.

In two types of flushing modes: a full flushing mode and a partial flushing mode, to be performed by the flush water tank assembly in the first embodiment, fundamental operations during the full flushing mode and during the partial flushing mode are the same, except that: a time period of an open state of the water discharge port 20 of the water storage tank 18 during the full flushing mode is greater than that during the partial flushing mode, because a pull-up amount of the valve element 24*a* of the water discharge valve device 24 by the control wire 28 during the full flushing mode is greater than that during the partial flushing mode; and the dead water level DWL during the full flushing mode is lower than that during the partial flushing mode. Thus, the following description will be made about only operations during the full flushing mode.

Firstly, as illustrated in FIGS. 2, 5, 7, 8 and 9*a*, in a state just before start of water discharge by the water discharge valve device 24 (water stopping state) at a clock time t0, the valve element 24*a* of the water discharge valve device 24 closes up the water discharge port 20, so that an initial water level within the water storage tank 18 becomes equal to the maximum water level WL0, a part of the float 38 lower than the upper end other than the buoyancy generating portion 38*b* is located under flush water, and whole of the small tank 34 and the openable and closable valve 36 are also located under flush water.

Figure 9A:
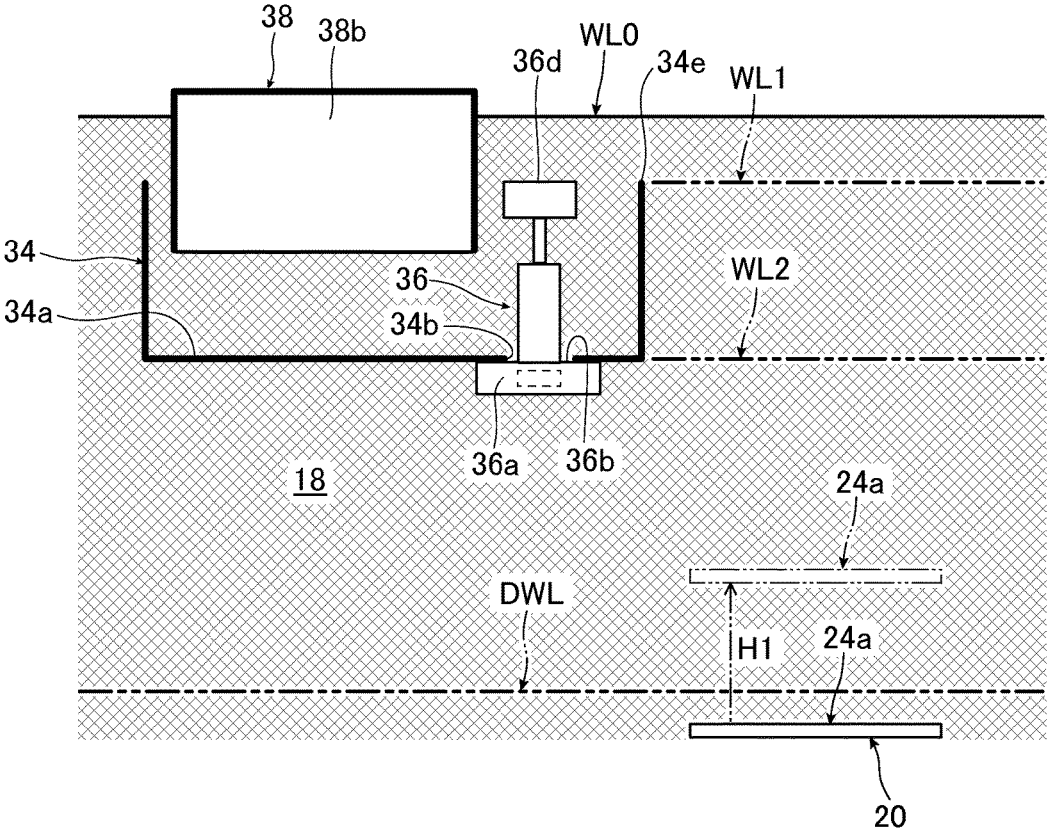
FIG. 9*a* schematically illustrates operations of a float and an openable and closable valve of the flush water supply device in the flush water tank assembly according to the first embodiment of the present invention.

Thereafter, when a user operates the manual operation lever 26 (see FIG. 2) at a clock time t1 in FIG. 8, the valve element 24*a* of the water discharge valve device 24 is pulled upwardly to the height H1 by a control wire 28 as illustrated in FIG. 9*a* to open the water discharge port 20 of the water storage tank 18. Then, water discharge to the toilet main unit 2 of the flush toilet 1 in the full flushing mode caused by the water discharge valve device 24 of the flush water tank assembly 16 is started, and the water level within the water storage tank 18 is lowered from the maximum water level WL0.

After that, as illustrated in FIGS. 2, 5, 7 and 9*a*, when the water level within the water storage tank 18 is lowered beyond the water level WL1 around the upper edge 34*e* of the small tank 34, only the water level within the water storage tank 18 outside the small tank 34 is lowered while maintaining the water level within the small tank 34 at the maximum water level w0.

Thus, the float 38 is moved upwardly by means of buoyancy based on flush water in the small tank 34, and then maintained in a stationary state at its uppermost position.

During the lowering of the water level of flush water within the water storage tank 18 from the water level WL1 to the water level WL2 around adjacent to the bottom wall 34*a* of the small tank 34, the openable and closable valve 36 is moved upwardly by means of buoyancy generated at the buoyancy generating portion 36*a* and the valve portion 36*b* of the openable and closable valve 36 based on flush water within the storage tank 18 and of buoyancy generated at the auxiliary float element 36*d* of the openable and closable valve 36 based on flush water within the small tank 34. Thus, the opening 34*b* of the small tank 34 is closed by the valve portion 36*b* of the openable and closable valve 36. Then, the float 38 is moved upwardly by means of buoyancy based on flush water in the small tank 34, and maintained in a stationary state at its uppermost position, so that the water supply valve 32 of the flush water supply device 22 is closed and water is not supplied into the water storage tank 18.

Figure 9B:
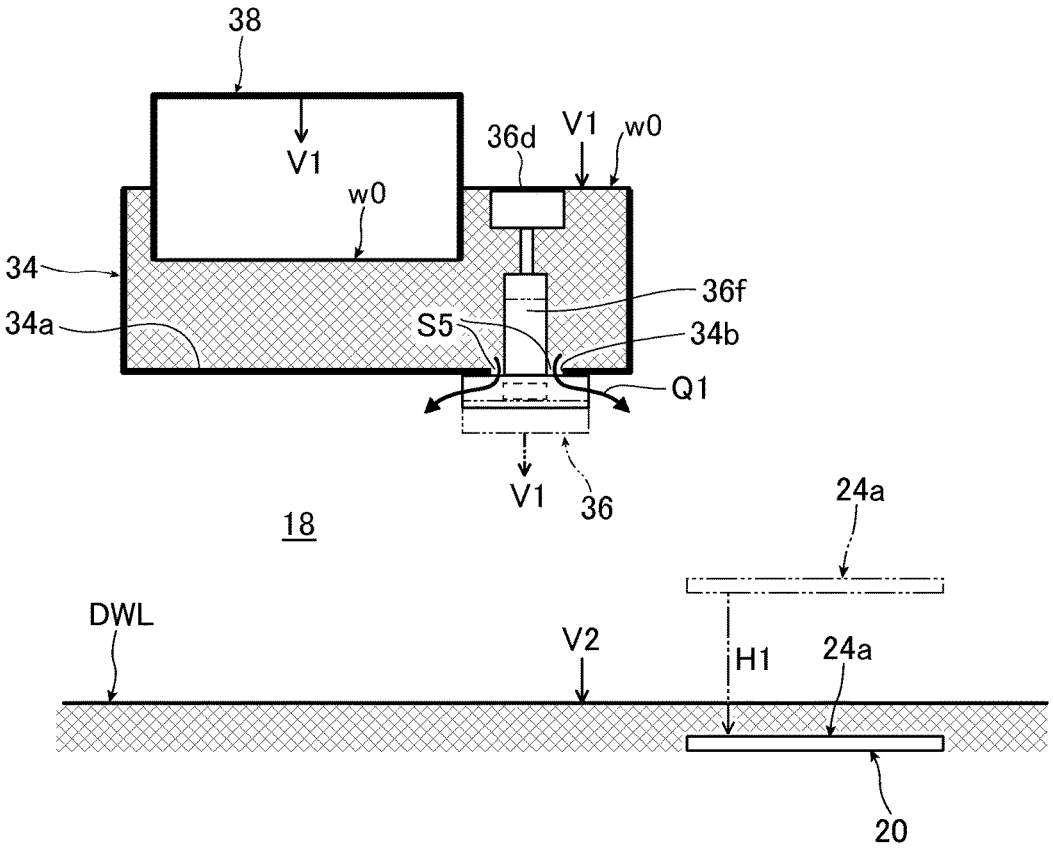
FIG. 9*b* schematically illustrates operations of the float and the openable and closable valve of the flush water supply device in the flush water tank assembly according to the first embodiment of the present invention.

Then, after the clock time t1 in FIG. 8, when the water level of flush water within the storage tank 18 is lowered, the valve element 24*a* of the water discharge valve device 24 is moved downwardly along with the water level within the water storage tank 18. Further, at the clock time t2 in FIG. 8, when the water level of flush water within the storage tank 18 continues to be lowered beyond the water level WL2 around adjacent to the bottom wall 34*a* of the small tank 34, the buoyancy generating portion 36*a* and the valve portion 36*b* of the openable and closable valve 36 lose their buoyancy, so that whole of the openable and closable valve 36 is moved downwardly to open the opening 34*b* of the small tank 34, as illustrated in FIG. 9*b*. In this process, as illustrated in FIG. 9*b*, the openable and closable valve 36 becomes in a floating state by means of buoyancy working on the auxiliary float element 36*d* based on flush water within the small tank 34, and is moved downwardly at a relatively slow speed equal to the speed V1 of lowering of the water level within the small tank 34 (hereinafter, referred to as "small tank water level lowering speed V1"). That is, the opening 34*b* of the small tank 34 becomes in a state where a part of the large diameter segment 36*f* of the support portion 36*c* of the openable and closable valve 36 is passing through the opening 34*b* of the small tank 34. In this state, the opening area S5 formed between the outer peripheral surface of the large diameter segment 36*f* and the circumferential surface of the opening 34*b* of the small tank 34 (an area provided by subtracting the cross-section area S3 of the large diameter segment 36*f* of the openable and closable valve 36 from the opening cross-section area S0 of the opening 34*b* of the small tank 34 (S5=S0−S3)) is relatively small, and the flow rate Q1 of flush water within the small tank 34 drainable from the opening 34*b* into the water storage tank 18 is also relatively low. Thus, the small tank water level lowering speed V1 is slower than a speed V2 of lowering of the water level within the water storage tank 18 (V1<V2), so that the water level within the small tank 34 is lowered from the maximum water level relatively slowly.

Subsequently, when the water level within the water storage tank 18 is lowered to the dead water level DWL at a clock time t3 in FIG. 8, the valve element 24*a* of the water discharge valve device 24 is moved downwardly to close the water discharge port 20 again, as illustrated in FIG. 9*b*.

Figure 9C:
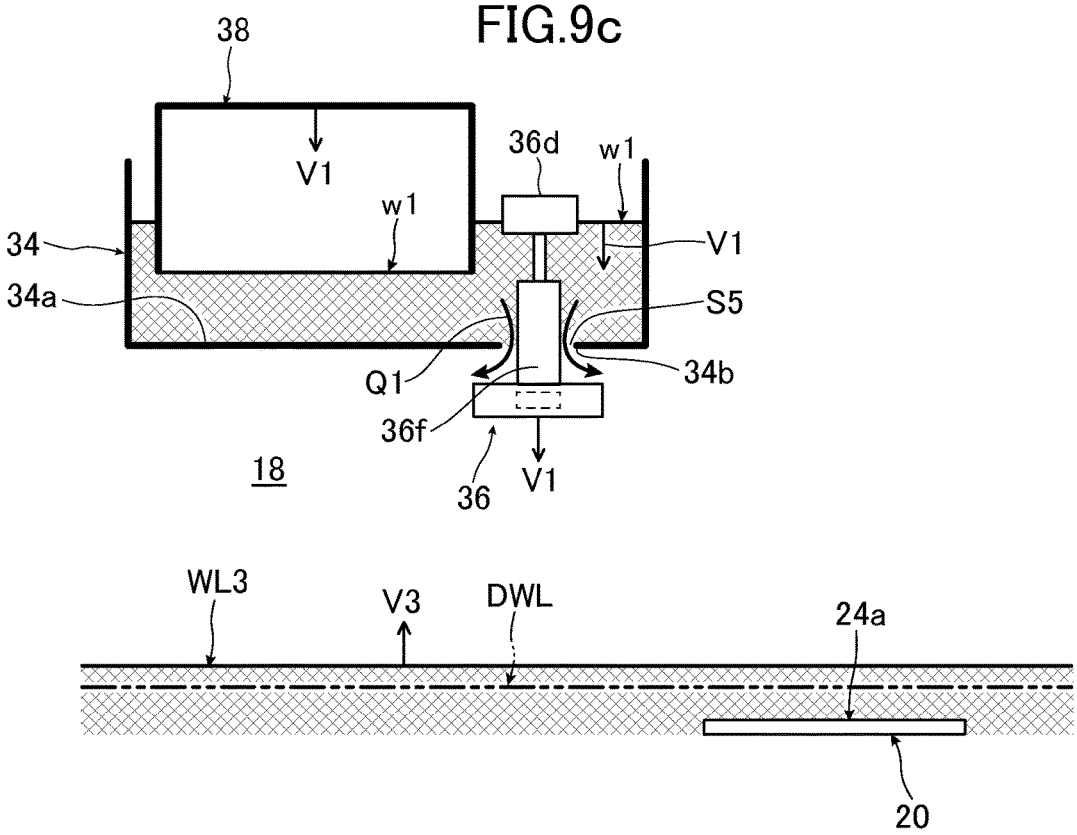
FIG. 9*c* schematically illustrates operations of the float and the openable and closable valve of the flush water supply device in the flush water tank assembly according to the first embodiment of the present invention.

Then, at a clock time t4 in FIG. 8, the water level within the small tank 34 is lowered to the water level w1 causing start of water supply through the flush water supply device 22 into the water storage tank 18, as illustrated in FIG. 9*c*. This causes the float 38 to be moved downwardly, and, as illustrated in FIG. 3, the swingable member 40 of the flush water supply device 22 opens the water supply valve 32. In this state, water supply is started from the outlet port 30*c* of the secondary water supply passage of the water supply pipe 30, and the water level WL3 within the water storage tank 18 becomes higher than the dead water level DWL at a speed V3. During a time period from the clock time t2 to the clock time t4 in FIG. 8, as illustrated in FIG. 9*c*, the openable and closable valve 36 is in a floating state by means of buoyancy working on the auxiliary float element 36*d* based on flush water within the small tank 34, and the large diameter segment 36*f* of the support portion 36*c* of the openable and closable valve 36 is passing through the opening 34*b* of the small tank 34. In this state, the opening area S5 (=S0−S3) formed between the outer peripheral surface of the large diameter segment 36*f* and the circumferential surface of the opening 34*b* of the small tank 34 is relatively small. Then, the float 38 and the auxiliary float element 36*d* of the openable and closable valve 36 that are floating by means of buoyancy based on flush water within the small tank 34 are being moved downwardly at a relatively slow speed equal to the small tank water level lowering speed V1.

Figure 9D:
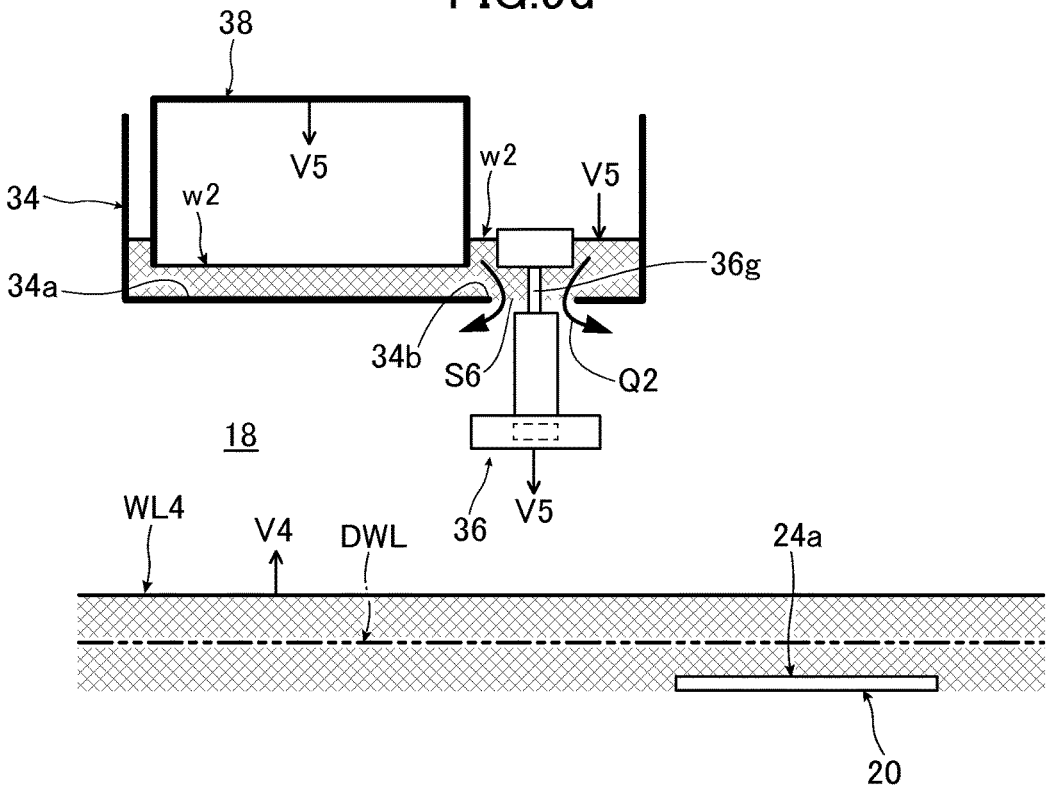
FIG. 9*d* schematically illustrates operations of the float and the openable and closable valve of the flush water supply device in the flush water tank assembly according to the first embodiment of the present invention.

Subsequently, after the clock time t4 in FIG. 8, as illustrated in FIG. 9*d*, when the water level within the small tank 34 is further lowered to the water level w2 to cause the openable and closable valve 36 to be moved downwardly, a part of the small diameter segment 36*g* of the support portion 36*c* of the openable and closable valve 36 becomes passing through the opening 34*b* of the small tank 34. In this state, the opening area S6 formed between the outer peripheral surface of the small diameter segment 36*g* and the circumferential surface of the opening 34*b* of the small tank 34 (an area provided by subtracting the cross-section area S4 of the small diameter segment 36*g* of the openable and closable valve 36 from the opening cross-section area S0 of the opening 34*b* of the small tank 34 (S6=S0−S4)) is larger than the opening area S5 between the outer peripheral surface of the large diameter segment 36*f* and the circumferential surface of the opening 34*b* of the small tank 34. Thus, the flow rate Q2 of flush water within the small tank 34 drainable from the opening 34*b* into the water storage tank 18 is also increased relative to the flow rate Q1 of flush water within the small tank 34 drainable from the opening 34*b* into the water storage tank 18 during the time period from the clock time t2 to the clock time t4 in FIG. 8. Therefore, the water level of flush water within the water storage tank 18 is raised, based on water supply from the flush water supply device 22, to the water level WL4 at a speed V4 faster than the speed V3 of rising of the water level within the water storage tank 18 illustrated in FIG. 9*c*, due to the increase in flow rate of flush water drainable from the opening 34*b* of the small tank 34 into the water storage tank 18.

Further, the speed V5 of lowering of the water level within the small tank 34 (hereinafter, referred to as "small tank water level lowering speed V5") is also accelerated to a speed faster than the small tank water level lowering speed V1 during the time period from the clock time t2 to the clock time t4 in FIG. 8 before the water discharge port 20 is closed by the valve element 24*a* of the water discharge valve device 24. Then, the float 38 and the auxiliary float element 36*d* of the openable and closable valve 36 that are floating by means of buoyancy based on flush water within the small tank 34 are moved downwardly at a speed equal to the accelerated small tank water level lowering speed V5.

Figure 9E:
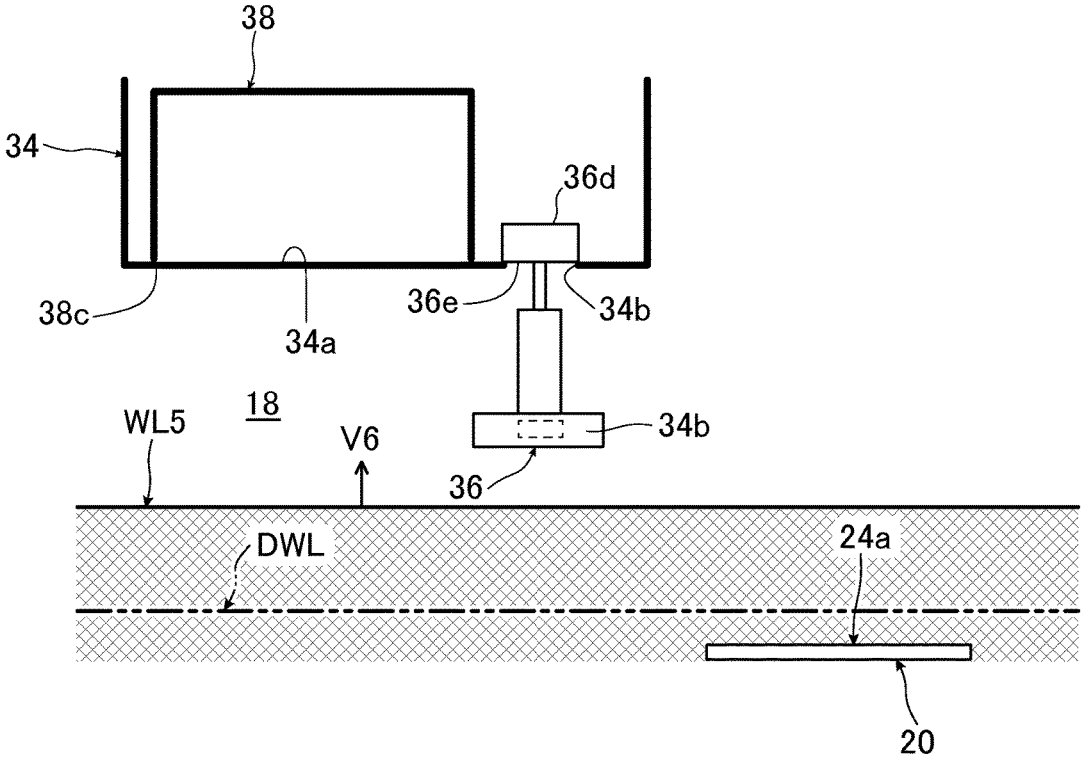
FIG. 9*e* schematically illustrates operations of the float and the openable and closable valve of the flush water supply device in the flush water tank assembly according to the first embodiment of the present invention.

Subsequently, at a clock time t5 in FIG. 8, when all flush water within the small tank 34 has been drained from the opening 34*b* into the water storage tank 18, and the small tank 34 becomes in an empty state as illustrated in FIG. 9*e*, the float 38 and the auxiliary float element 36*d* of the openable and closable valve 36 are rapidly moved downwardly by completely losing their buoyancy based on flush water in the small tank 34, and the lower end 38*b* of the float 38 becomes in contact with the bottom wall 34*a* of the small tank 34.

Further, whole of the openable and closable valve 36 is moved downwardly, and the lower end 36*e* of the auxiliary float element 36*d* thereof is brought into contact with the upper edge of the opening 34*b* of the small tank 34, so that whole of the openable and closable valve 36 becomes hanging from the opening 34*b* of the small tank 34. In this state, water supply from the flush water supply device 22 to the water storage tank 18 is continued, so that flush water within the water storage tank 18 is raised at a speed V6 to a water level WL5 at a position lower than the height position of the lower surface of the buoyancy generating portion 36*a* of the openable and closable valve 36. Further, the speed V6 of rising of the water level WL5 in the water storage tank 18 becomes slower than the speed V4 of rising of the water level WL4 in the water storage tank 18 illustrated in FIG. 9*d*, due to the absence of flush water drainable from the opening 34*b* of the small tank 34 into the water storage tank 18.

Furthermore, as illustrated in FIG. 9*e*, when the small tank 34 is in an empty state, the float 38 is moved to its lowermost position. In this state, air is reversibly replaceable between the internal space of the buoyancy generating portion 38*b* and a space outside the float 38 via e.g., a gap between the lower end 38*c* of the float 38 and the bottom wall 34*a* of the small tank 34.

Figure 9F:
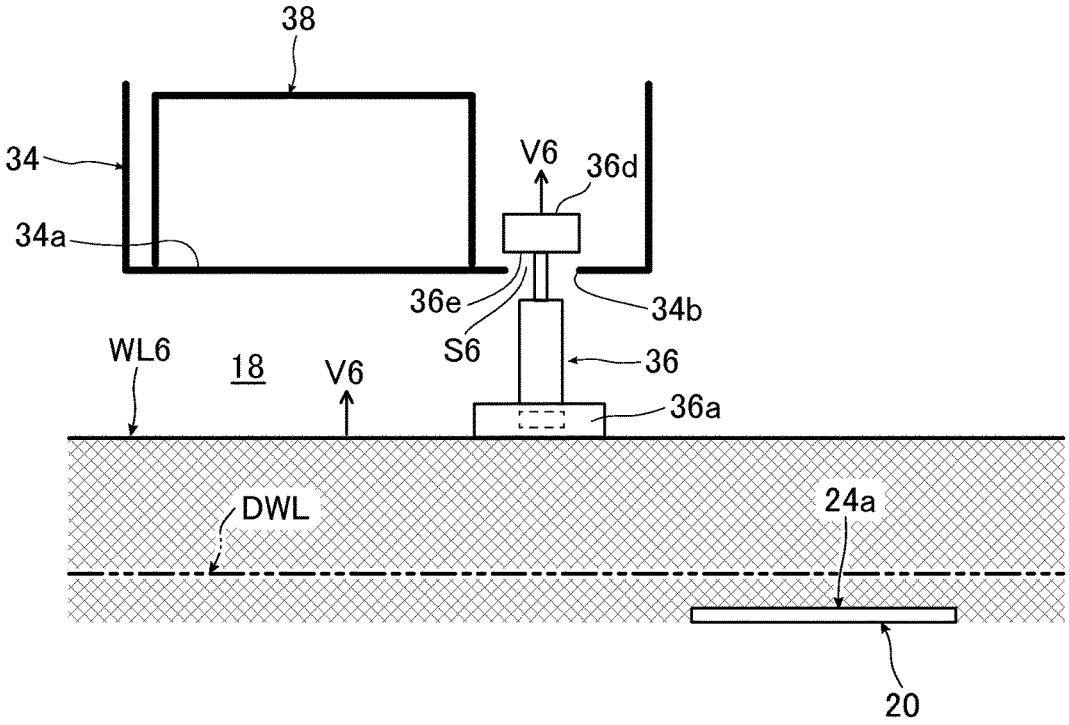
FIG. 9*f* schematically illustrates operations of the float and the openable and closable valve of the flush water supply device in the flush water tank assembly according to the first embodiment of the present invention.

Subsequently, at the clock time t5 in FIG. 8, water supply from the flush water supply device 22 to the water storage tank 18 is continued, and, as illustrated in FIG. 9*f*, the water level within the water storage tank 18 is further raised at a speed equal to the speed V6 of rising of the water level WL5 in the water storage tank 18 as illustrated in FIG. 9*e*. In this process, the water level within the water storage tank 18 becomes in contact with a lower end surface of the buoyancy generating portion 36*a* of the openable and closable valve 36, and the openable and closable valve 36 is further moved upwardly with the rising water level WL6. Then, as illustrated in FIG. 9*f*, the lower end 36*e* of the auxiliary float element 36*d* of the openable and closable valve 36 that was in contact with the upper edge of the opening 34*b* of the small tank 34 in FIG. 9*e* is also moved upwardly at a speed equal to the speed V6 of rising of the water level WL6 in the water storage tank 18, and the opening 34*b* of the small tank 34 becomes opened with the opening area S6. Further, as illustrated in FIG. 9*f*, the small tank 34 also remains in an empty state.

Figure 9G:
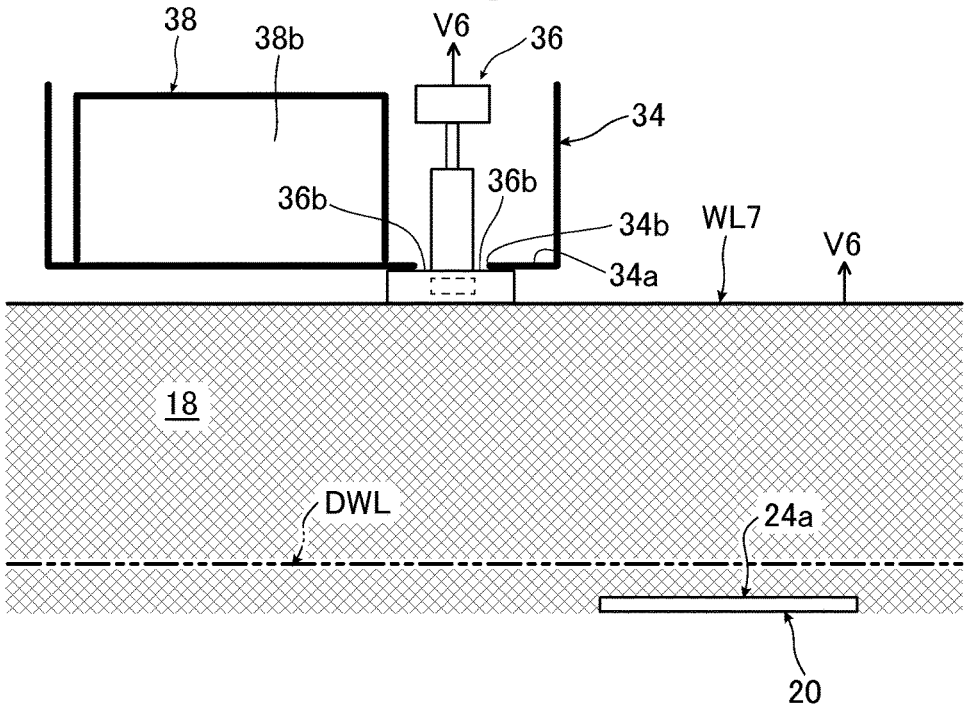
FIG. 9*g* schematically illustrates operations of the float and the openable and closable valve of the flush water supply device in the flush water tank assembly according to the first embodiment of the present invention.

Subsequently, when water supply from the flush water supply device 22 to the water storage tank 18 is continued, and the water level within the water storage tank 18 is further raised to a water level WL7 near the bottom wall 34*a* of the small tank 34 at the speed V6 as illustrated in FIG. 9*g*, the openable and closable valve 36 is further moved upwardly and the valve portion 36*b* is brought into contact with the lower edge of the single opening 34*b* of the small tank 34 to thereby close the opening 34*b*. In this state, the small tank 34 remains in an empty state, and the float 38 is moved downwardly to its lowermost position, so that the water supply valve 32 remains opened.

Figure 9H:
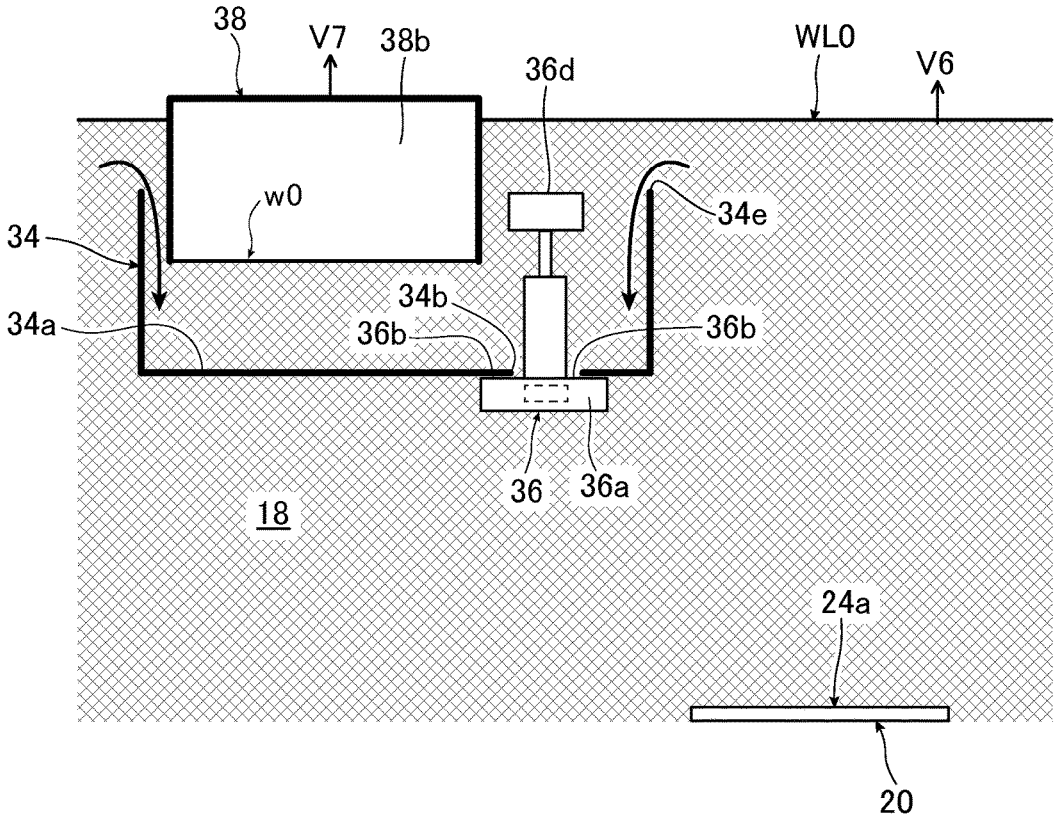
FIG. 9*h* schematically illustrates operations of the float and the openable and closable valve of the flush water supply device in the flush water tank assembly according to the first embodiment of the present invention.

Then, at a clock time t6 in FIG. 8, as illustrated in FIG. 9*h*, when the water level in the water storage tank 18 is raised at the speed V6 to a position higher than the position of the upper edge 34*e* of the small tank 34, flush water within the water storage tank 18 flows into the small tank 34 beyond the upper edge 34*e* of the small tank 34. As a result, the water level within the small tank 34 is raised rapidly and fills up the small tank 34. In this state, the buoyancy generating portion 38*b* of the float 38 is filled with sufficient air that was previously replaced with the outside air when it was in the state illustrated in FIG. 9*e*. Thus, the float 38 is rapidly moved upwardly to its uppermost position at a speed V7 that is faster than the speed V6 of rising of the water level in the water storage tank 18. This causes the water supply valve 32 to be promptly closed to stop the water supply from the flush water supply device 22 to the water storage tank 18. As illustrated in FIGS. 5 and 9*h*, although air is held in the internal space (buoyancy generating portion 38*b*) of the float 38, and the flush water in the small tank 34 scarcely flows into the internal space of the float 38, the water level w0 within the small tank 34 is located slightly above the lower end 38*c* of the float 38 due to a pressure of flush water around the lower end 38*c* of the float 38.

Further, the openable and closable valve 36 is also maintained in a state at its uppermost position by means of buoyancy generated at the buoyancy generating portion 36*a* and the valve portion 36*b* of the openable and closable valve 36 based on flush water within the water storage tank 18 and of buoyancy generated at the auxiliary float element 36*d* of the openable and closable valve 36 based on flush water within the small tank 34. Thus, the opening 34*b* of the small tank 34 is closed by the valve portion 36*b* of the openable and closable valve 36.

Eventually, the water level within the water storage tank 18 becomes equal to the maximum water level WL0 as illustrated in FIG. 9*h*, and a series of operations in the full flushing mode performed by the flush water tank assembly 16 of the first embodiment is completed.

In the flush water tank assembly 16 according to the first embodiment of the present invention, the opening area of the opening 34*b* of the small tank 34 can be changed in a course of opening or closing the opening 34*b* by the openable and closable valve 36 by setting it to the opening area S5 formed between the outer peripheral surface of the large diameter segment 36*f* of the openable and closable valve 36 and the circumferential surface of the opening 34*b* of the small tank 34, or to the opening area S6 formed between the outer peripheral surface of the small diameter segment 36*g* of the openable and closable valve 36 and the circumferential surface of the opening 34*b* of the small tank 34 as drainable water increasing means capable of increasing a flow rate of flush water drainable from the opening 34*b* of the small tank 34 into the water storage tank 18 at the clock time t4 in FIG. 8 after the water discharge port 20 of the water storage tank 18 is closed by the valve element 24*a* of the water discharge valve device 24 at the clock time t3 in FIG. 8. This makes it possible to change the flow rate of flush water drainable from the opening 34*b* of the small tank 34 into the water storage tank 18. Thus, it becomes possible to reduce wasteful water that is supplied from the flush water supply device 22 into the water storage tank 18 and discharged to the toilet main unit 2 together with flush water preliminarily stored in the water storage tank 18 (so-called "tail flushing water") with a simple structure, from when the water discharge port 20 of the water storage tank 18 is opened by the valve element 24*a* of the water discharge valve device 24 until when the water discharge port 20 is closed.

Further, when the valve element 24*a* of the water discharge valve device 24 closes the water discharge port 20 of the water storage tank 18 at the clock time t3 in FIG. 8 (see FIG. 9*b*), and thereafter, the water level within the small tank 34 passes through the position of water level w1 at the clock time t4 as illustrated in FIG. 9*d*, the speed of lowering of the water level within the small tank 34 is accelerated from the speed V1 (see FIG. 9*c*) to the speed V5 (see FIG. 9*d*). This makes it possible to increase the flow rate of flush water drainable from the opening 34*b* of the small tank 34 into the water storage tank 18. That is, the speed of lowering of the water level within the small tank 34 and of the auxiliary float element 36*d* of the openable and closable valve 36 can be made relatively slow from when the water discharge port 20 of the water storage tank 18 is opened by the valve element 24*a* of the water discharge valve device 24 until when the water discharge port 20 is closed. Thus, the float 38 can also be moved downwardly at a slow speed along with the lowering of the water level within the small tank 34. This makes it possible to delay a timing of opening of the water supply valve 32 by the swingable member 40 to start water supply to inside the flush water tank. Therefore, it becomes possible to reduce wasteful water that is supplied through the water supply valve 32 into the water storage tank 18 and discharged to the toilet main unit together with flush water preliminarily stored in the water storage tank 18 (so-called "tail flushing water").

Further, after the water level within the small tank 34 passes through the position of water level w2 after the water discharge port 20 of the water storage tank 18 is closed by the valve element 24*a* of the water discharge valve device 24 (see FIG. 9*d*), drainable water increasing means can facilitate increase in a speed of lowering of the water level within the small tank 34, the float 38 and the auxiliary float element 36*d* of the openable and closable valve 36 within the small tank 34, so that flush water within the small tank 34 can be drained in a short period of time to achieve an empty state of the small tank 34 (see FIG. 9*e*). Consequently, air can be reversibly replaced between the internal space for generating buoyancy of the buoyancy generating portion 36*a* of the float 38 and a space outside the float, so that when flush water is subsequently supplied into the small tank 34 to cause the float 38 to be moved upwardly to perform water stopping operation of the water supply valve 32, buoyancy can be generated so as to normally operate the float 38. Therefore, even if an amount of flush water to be stored in the water storage tank 18 and supplied to the toilet main unit 2 is reduced according to the need for water-saving, it becomes possible to reduce the tail flushing water and replace the air inside the float 38 to operate the float 38 in a normal way.

Further, in the flush water tank assembly 16 according to the first embodiment, the drainable water increasing means capable of increasing a flow rate of flush water drainable from the opening 34*b* of the small tank 34 into the water storage tank 18 after the water discharge port 20 of the water storage tank 18 is closed by the valve element 24*a* of the water discharge valve device 24 includes: the single opening 34*b* in the bottom wall 34*a* of the small tank 34; the openable and closable valve 36 configured to open and close the single opening 34*b*; and the auxiliary float element 36*d* provided on the openable and closable valve 36, and the support portion 36*c* extending upwardly from the valve portion 36*d* of the openable and closable valve 36 has the large diameter segment 36*f* and the small diameter segment 36*g* insertable into the single opening 34*b* in the bottom wall 34*a* of the small tank 34, whereby the opening area of the single opening 34*b* in the bottom wall 34*a* of the small tank 34 can be changed to the opening area S5 or the opening area S6 when the large diameter segment 36*f* and the small diameter segment 36*g* of are moved upwardly and downwardly. This makes it possible to facilitate change in a flow rate of flush water drainable from the single opening 34*b* of the small tank 34 into the water storage tank 18 according to the upward and downward movement of the large diameter segment 36*f* and the small diameter segment 36*g* of the openable and closable valve 36.

In particular, from when the flushing mode is started by the flush water tank assembly 16 at the clock time t1 in FIG. 8 and the water discharge port 20 of the water storage tank 18 is opened by valve element 24*a* of the water discharge valve device 24 until when the water discharge port 20 is closed at the clock time t3 in FIG. 8, the openable and closable valve 36 is in either of the following two states: where buoyancy is generated at the buoyancy generating portion 36*a* of the openable and closable valve 36 based on flush water in the water storage tank 18, and the valve portion 36*b* of the openable and closable valve 36 is moved upwardly to close the single opening 34*b* in the bottom wall 34*a* of the small tank 34; or where buoyancy is not generated at the buoyancy generating portion 36*a* of the openable and closable valve 36 based on flush water in the water storage tank 18, and is generated at the auxiliary float element 36*d* of the openable and closable valve 36 based on flush water in the small tank 34. Thus, even when the valve portion 36*b* of the openable and closable valve 36 opens the single opening 34*b* in the bottom wall 34*a* of the small tank 34 during the time period from the clock time t2 to the clock time t4 in FIG. 8, flush water in the small tank 34 is drained into the water storage tank 18 through a relatively small opening area S5 formed between the large diameter segment 36*f* of the support portion 36*c* of the openable and closable valve 36 and the single opening 34*b* of the small tank 34. Therefore, the speed V1 of lowering of the water level within the small tank 34 and of the auxiliary float element 36*d* of the openable and closable valve 36 (see FIGS. 9*b* and 9*c*) can be made relatively slow. This makes it possible to reduce the "tail flushing water" with a simple structure of the openable and closable valve 35 from when the water discharge port 20 of the water storage tank 18 is opened by the valve element 24*a* of the water discharge valve device 24 until when the water discharge port 20 is closed.

Further, after the clock time t4 in FIG. 8, as illustrated in FIG. 9*d*, when the water level within the small tank 34 passes through the position of water level w2 after the water discharge port 20 is closed by the valve element 24*a* of the water discharge valve device 24, buoyancy is generated at the auxiliary float element 36*d* of the openable and closable valve 36 based on flush water in the small tank 34. In this state, flush water in the small tank 34 is drained into the water storage tank 18 through a relatively large opening area S6 formed between the small diameter segment 36*g* of the support portion 36*c* of the openable and closable valve 36 and the single opening 34*b* of the small tank 34. Thus, a speed V5 of lowering of water level in the small tank 34 and of the auxiliary float element 36*d* of the openable and closable valve 36 can be increased, so that flush water within the small tank 34 can be drained in a short period of time to achieve an empty state of the small tank 34. Consequently, air can be reversibly replaced between the internal space for generating buoyancy of the buoyancy generating portion 38*b* of the float 38 and a space outside the float 38, so that when flush water is subsequently supplied to inside the small tank 34 to cause the float 38 to be moved upwardly to perform water stopping operation of the water supply valve, buoyancy can be generated so as to normally operate the float 38.

As a result, even if an amount of flush water to be stored in the water storage tank 18 and supplied to the toilet main unit 2 is reduced according to the need for water-saving, it becomes possible to reduce the tail flushing water and replace the air inside the buoyancy generating portion 38*b* of the float 38 to operate the float 38 in a normal way.

The flush water tank assembly 16 of the first embodiment has been described above based on a configuration in which the single opening 34*b* is provided in the bottom wall 34*a* of the small tank 34. Alternatively, the opening may be provided e.g., at a lower part of a lateral wall of the small tank 34.

Further, the flush water tank assembly 16 of the first embodiment has been described based on a configuration in which the timing of allowing the speed V5 of lowering of water level within the small tank 34 to be faster than the small tank water level lowering speed V1 at the time when the valve element 24*a* of the water discharge valve device 24 opens the water discharge port 20 is set to the clock time t4 in FIG. 8 after the water discharge port 20 is closed by the valve element 24*a* of the water discharge valve device 24 at the clock time t3 in FIG. 8, to thereby increase the flow rate of flush water drainable from the opening 34*b* of the small tank 34 into the water storage tank 18 from the flow rate Q1 to the flow rate Q2. However, the embodiment is not limited to this configuration, but other configurations may also be applicable. For example, as one of the other configurations, the timing of allowing the speed V5 of lowering of water level within the small tank 34 to be faster than the speed V1 at the time when the valve element 24*a* of the water discharge valve device 24 opens the water discharge port 20 may be set to the same time as the water discharge port 20 is closed by the valve element 24*a* of the water discharge valve device 24 at the clock time t3.

Secondly, based on FIGS. 10*a* to 10*f*, a flush water tank assembly according to a second embodiment of the present invention will be described below.

FIGS. 10*a* to 10*f* schematically illustrate structures and operations of a float, a first openable and closable valve, and a second openable and closable valve of the flush water supply device in the flush water tank assembly according to the second embodiment of the present invention.

As illustrated in FIGS. 10*a* to 10*f*, the flush water tank assembly 116 according to the second embodiment of the present invention is structurally different from the flush water tank assembly 16 of the first embodiment in that there are two openings, a first opening 134*b* and a second opening 134*c*, formed in the bottom wall 134*a* of a small tank 134, and each of a first openable and closable valve 136 and a second openable and closable valve 236 is attached to respective one of the first opening 134*b* and the second opening 134*c* so as to become capable of being moved upwardly and downwardly, but the remaining elements or components thereof are the same as those in the first embodiment. Thus, in FIGS. 10*a* to 10*f*, the same element or component as that in the flush water tank assembly according to the first embodiment of the present invention is assigned with the same reference numeral or code, the description thereof will be omitted, and only the differences from the first embodiment will be described below.

Figure 10A:
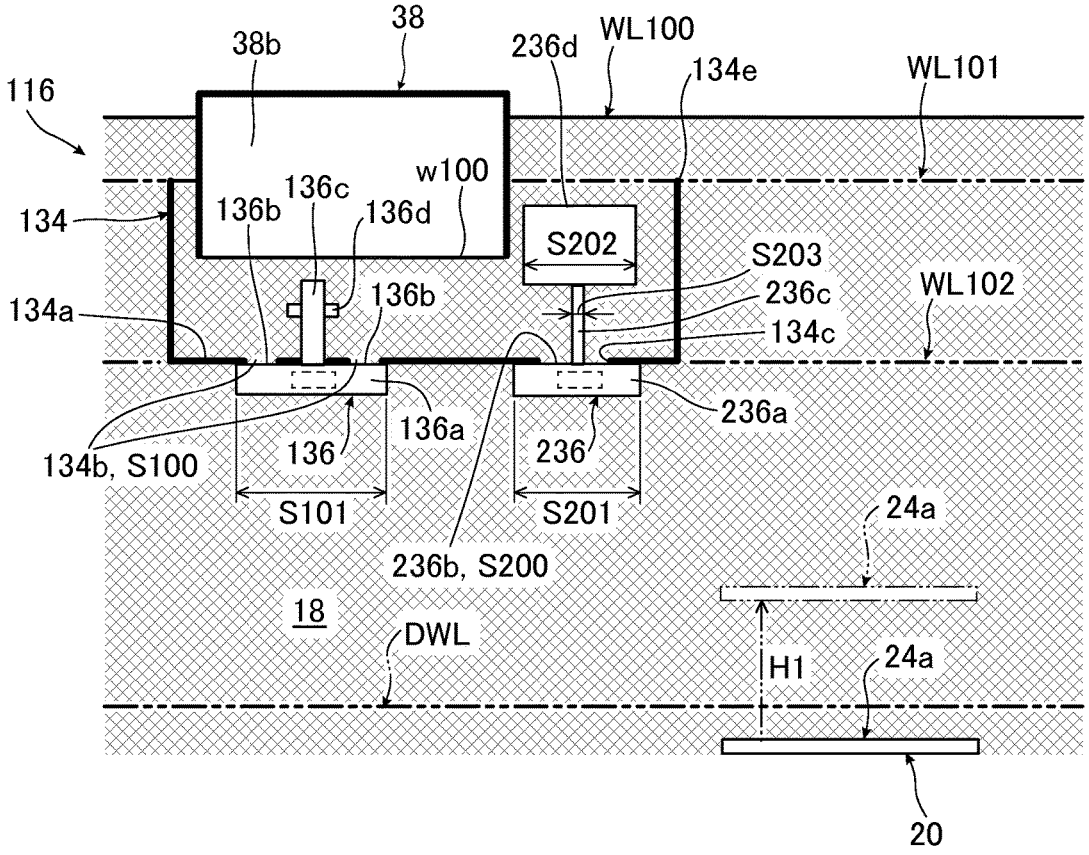
FIG. 10*a* schematically illustrates structures and operations of a float, a first openable and closable valve, and a second openable and closable valve of the flush water supply device in the flush water tank assembly according to a second embodiment of the present invention.

As illustrated in FIG. 10*a*, the first openable and closable valve 136 attached openably and closeably to the first opening 134*b* in the bottom wall 134*a* of the small tank 134 includes: a buoyancy generating portion 136*a* provided at a lower end thereof in such a manner as to generate buoyancy based on flush water within the water storage tank 18; a generally cylindrically-shaped (disk-shaped) valve portion 136*b* having a space thereinside, that is adapted to be moved upwardly and downwardly to thereby open and close the first opening 134*b*; a support portion 136*c* extending upwardly from the valve portion 136*b*; and a protrusion 136*d* formed to outwardly protrude from the support portion 136*c* and configured to prevent falling of the first openable and closable valve 136. The valve portion 136*b* has a cross-section area S101 larger than an opening cross-section area S100 of the first opening 134*b* of the small tank 134, and is adapted to, when the water level of flush water within the water storage tank 18 is around adjacent to or higher than the bottom of the small tank 134, be moved upwardly by means of buoyancy generated in the buoyancy generating portion 136*a*, and brought into contact with a lower edge of the first opening 134*b* of the small tank 134, thereby to close the first opening 134*b* (see FIG. 10*a*). On the other hand, the valve portion 136*b* is adapted to, when the water level of the flush water within the water storage tank 18 is around adjacent to or lower than the bottom of the small tank 134, be moved downwardly below the position of the first opening 134*b* in the bottom wall 134*a* of the small tank 134, thereby to open the first opening 134*b* (see FIG. 10*b*).

In the second embodiment, the first openable and closable valve 136 itself is made of a material having a specific gravity less than that of water (e.g., a resin material), and the buoyancy generating portion 136*a* of the first openable and closable valve 136 is configured to form a space for holding air therein. Alternatively, the buoyancy generating portion 136*a* may be made of a material having a specific gravity less than that of water (e.g., a resin material) and formed in a solid structure while eliminating a space for holding air therein.

Further, the second openable and closable valve 236 attached openably and closeably to the second opening 134*c* in the bottom wall 134*a* of the small tank 134 includes: a buoyancy generating portion 236*a* provided at a lower end thereof in such a manner as to generate buoyancy based on flush water within the water storage tank 18; a generally cylindrically-shaped (disk-shaped) valve portion 236*b* having a space thereinside, that is adapted to be moved upwardly and downwardly to thereby open and close the second opening 134*c*; a support portion 236*c* extending upwardly from the valve portion 236*b*; an auxiliary float element 236*d* provided on an upper end of the support portion 236*c*. The valve portion 236*b* has a cross-section area S201 larger than an opening cross-section area S200 of the second opening 134*c* of the small tank 134. The auxiliary float element 236*d* is formed in a generally cylindrical shape to have a space formed thereinside and to have a cross-section area S202 larger than the opening cross-section area S200 of the second opening 134*c* of the small tank 34. Further, the support portion 236*c* has a cross-section area S203 smaller than the opening cross-section area S200 of the second opening 134*c*.

In the second embodiment, the second openable and closable valve 236 itself is made of a material having a specific gravity less than that of water (e.g., a resin material), and the buoyancy generating portion 236*a* of the second openable and closable valve 236 is configured to form a space for holding air therein. Alternatively, the buoyancy generating portion 236*a* may be made of a material having a specific gravity less than that of water (e.g., a resin material) and formed in a solid structure while eliminating a space for holding air therein.

Next, with reference to FIGS. 10*a* to 10*f*, operations (functions) of the flush water tank assembly according to the second embodiment, and the flush toilet equipped with the flush water tank assembly, will be described.

In two types of flushing modes: a full flushing mode and a partial flushing mode, to be performed by the flush water tank assembly in the second embodiment, fundamental operations are the same. Thus, the following description will be made about only operations during the full flushing mode.

Firstly, as illustrated in FIG. 10*a*, in a state just before start of water discharge by the water discharge valve device 24 (water stopping state), the valve element 24*a* of the water discharge valve device 24 closes up the water discharge port 20, so that an initial water level within the water storage tank 18 becomes equal to the maximum water level WL100, a part of the float 38 lower than the upper end other than the buoyancy generating portion 38*b* is located under flush water, and whole of the small tank 134, the first openable and closable valve 136, and the second openable and closable valve 236 are also located under flush water.

Next, when a user operates the manual operation lever 26 (see FIG. 2), the valve element 24*a* of the water discharge valve device 24 is pulled upwardly to the height H1 by a control wire 28 as illustrated in FIG. 10*a* to open the water discharge port 20 of the water storage tank 18. Then, water discharge to the toilet main unit 2 of the flush toilet 1 in the full flushing mode caused by the water discharge valve device 24 of the flush water tank assembly 116 is started, and the water level within the water storage tank 18 is lowered from the maximum water level WL100.

After that, as illustrated in FIG. 10*a*, when the water level within the water storage tank 18 is lowered beyond the water level WL101 around the upper edge 134*e* of the small tank 134, only the water level within the water storage tank 18 outside the small tank 134 is lowered while maintaining the water level within the small tank 134 at the maximum water level w100. Thus, the float 38 is moved upwardly by means of buoyancy based on flush water in the small tank 134, and then maintained in a stationary state at its uppermost position.

During the lowering of the water level of flush water within the water storage tank 18 from the water level WL101 to the water level WL102 around adjacent to the bottom wall 134*a* of the small tank 134, the first openable and closable valve 136 is moved upwardly by means of buoyancy generated at the buoyancy generating portion 136*a* and the valve portion 136*b* of the openable and closable valve 136 based on flush water within the storage tank 18, as illustrated in FIG. 10*a*. Thus, the first opening 134*b* of the small tank 134 is closed by the valve portion 136*b* of the openable and closable valve 136.

Further, the second openable and closable valve 236 is moved upwardly by means of buoyancy generated at the buoyancy generating portion 236*a* and the valve portion 236*b* of the second openable and closable valve 236 based on flush water within the storage tank 18 and of buoyancy generated at the auxiliary float element 236*d* of the second openable and closable valve 236 based on flush water within the small tank 134, as illustrated in FIG. 10*a*. Thus, the opening 134*c* of the small tank 134 is closed by the valve portion 236*b* of the second openable and closable valve 236. Then, the float 38 is moved upwardly by means of buoyancy based on flush water in the small tank 134, and maintained in a stationary state at its uppermost position, so that the water supply valve 32 of the flush water supply device 22 is closed and water is not supplied into the water storage tank 18.

Figure 10B:
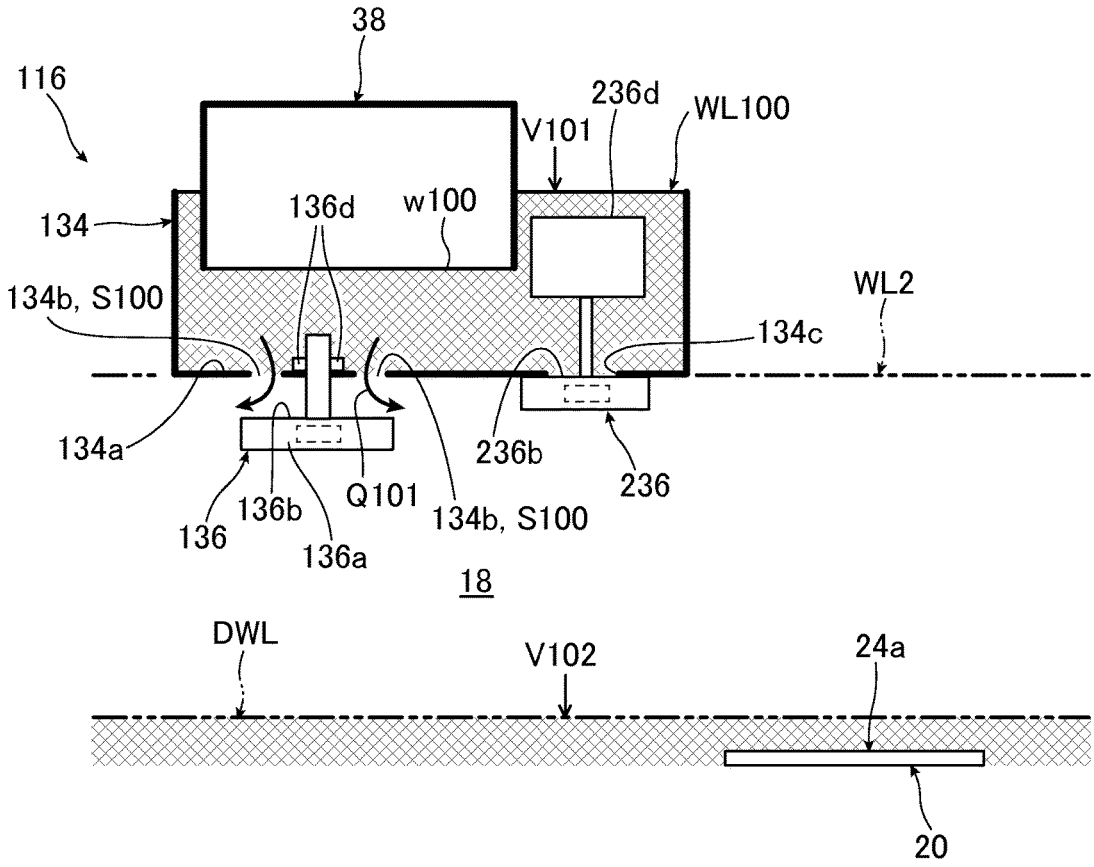
FIG. 10*b* schematically illustrates structures and operations of the float, the first openable and closable valve, and the second openable and closable valve of the flush water supply device in the flush water tank assembly according to the second embodiment of the present invention.

Then, as illustrated in FIG. 10*b*, when the water level of flush water within the storage tank 18 is lowered toward the dead water level DWL, the valve element 24*a* of the water discharge valve device 24 is moved downwardly along with the water level within the water storage tank 18. Further, when the water level of flush water within the storage tank 18 reaches the dead water level DWL, the valve element 24*a* of the water discharge valve device 24 closes the water discharge port 20. While the water level of flush water within the storage tank 18 is being lowered toward the dead water level DWL, when the water level of flush water within the storage tank 18 continues to be lowered beyond the water level WL102 around adjacent to the bottom wall 134*a* of the small tank 134, the buoyancy generating portion 136*a* and the valve portion 136*b* of the first openable and closable valve 136 lose their buoyancy, so that whole of the first openable and closable valve 136 is moved downwardly to open the opening 134*b* of the small tank 134. In this state, the protrusion 136*d* of the first openable and closable valve 136 is brought into contact with the bottom wall 134*a* of the small tank 134, so that whole of the first openable and closable valve 136 becomes hanging from the bottom wall 134*a* of the small tank 134.

On the other hand, as illustrated in FIG. 10*b*, the second openable and closable valve 236 is in a state at its uppermost position by means of buoyancy working on the auxiliary float element 236*d* based on flush water within the small tank 134. In this state, the valve portion 236*b* of the second openable and closable valve 236 closes the second opening 134*c* of the small tank 134.

Thus, flush water in the small tank 134 as illustrated in FIG. 10*b* is drained into the water storage tank 18 only from the first opening 134*b* with an opening area S100 that is opened by the first openable and closable valve 136. However, the opening area S100 of the first openable and closable valve 136 is relatively small, so that a flow rate Q101 of flush water drainable from the first opening 134*b* of the small tank 134 into the water storage tank 18 is also relatively low. Further, a speed V101 of lowering of the water level within the small tank 134 (hereinafter, referred to as "small tank water level lowering speed V101") from a maximum water level w100 is also relatively slow. Thus, the small tank water level lowering speed V101 is slower than a speed V102 of lowering of the water level within the water storage tank 18 (V101<V102), and the water level within the small tank 134 is lowered from the maximum water level relatively slowly.

Figure 10C:
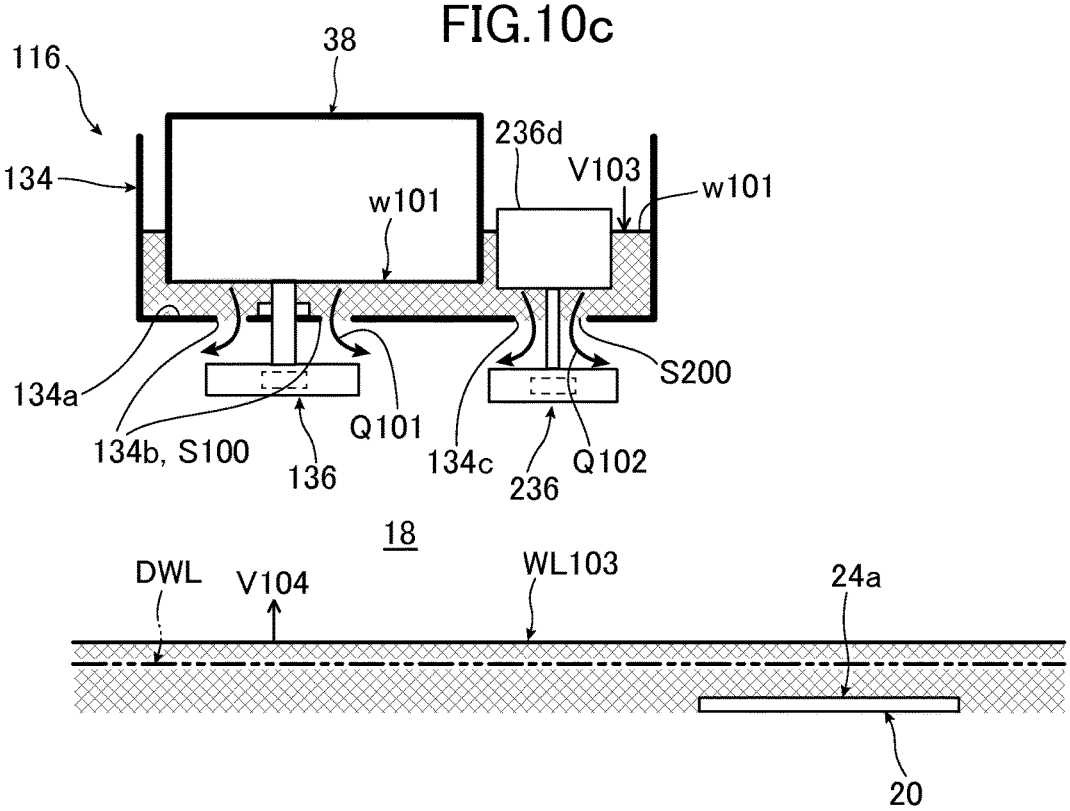
FIG. 10*c* schematically illustrates structures and operations of the float, the first openable and closable valve, and the second openable and closable valve of the flush water supply device in the flush water tank assembly according to the second embodiment of the present invention.

Subsequently, as illustrated in FIG. 10*c*, when the water level within the small tank 134 is further lowered to the water level w101, the float 38 is also moved downwardly along with the lowering of water level within the small tank 134. This causes the water supply valve 32 to be opened, and water supply from the flush water supply device 22 to the water storage tank 18 is started. In this process, the second openable and closable valve 236 is also moved downwardly to open the second opening 134*c* of the small tank 134. Thus, flush water within the small tank 134 is drained into the water storage tank 18 also from the opened second opening 134*c* at a flow rate Q102. In this state, flush water within the small tank 134 as illustrated in FIG. 10*c* is drained into the water storage tank 18 from both of the first opening 134*b* with the opening area S100 that is opened by the first openable and closable valve 136 and the second opening 134*c* with the opening area S200 that is opened by the second openable and closable valve 236. Thus, the total opening area opened (S100+S200) is increased relative to the case in which only the first opening 134*b* of the small tank 134 as illustrated in FIG. 10*b* is opened. Therefore, the total flow rate of flush water (Q101+Q102) drainable into the water storage tank 18 is increased by being drained from both of the first opening 134*b* and the second opening 134*c* of the small tank 134, so that a speed V103 of lowering of water level within the small tank 134 (hereinafter, referred to as "small tank water level lowering speed V103") is also accelerated to a speed faster than the small tank water level lowering speed V101 before the water discharge port 20 is closed by the valve element 24*a* of the water discharge valve device 24. Then, the float 38 and the auxiliary float element 236*d* of the second openable and closable valve 236 floating by means of buoyancy based on flush water within the small tank 134 are moved downwardly at a speed equal to the accelerated small tank water level lowering speed V103.

Further, the water level within the water storage tank 18 is raised from the dead water level DWL to a water level WL103 at a speed V104 based on flush water drained from both of the first opening 134*b* and the second opening 134*c* of the small tank 134, and on flush water supplied from the flush water supply device 22.

Figure 10D:
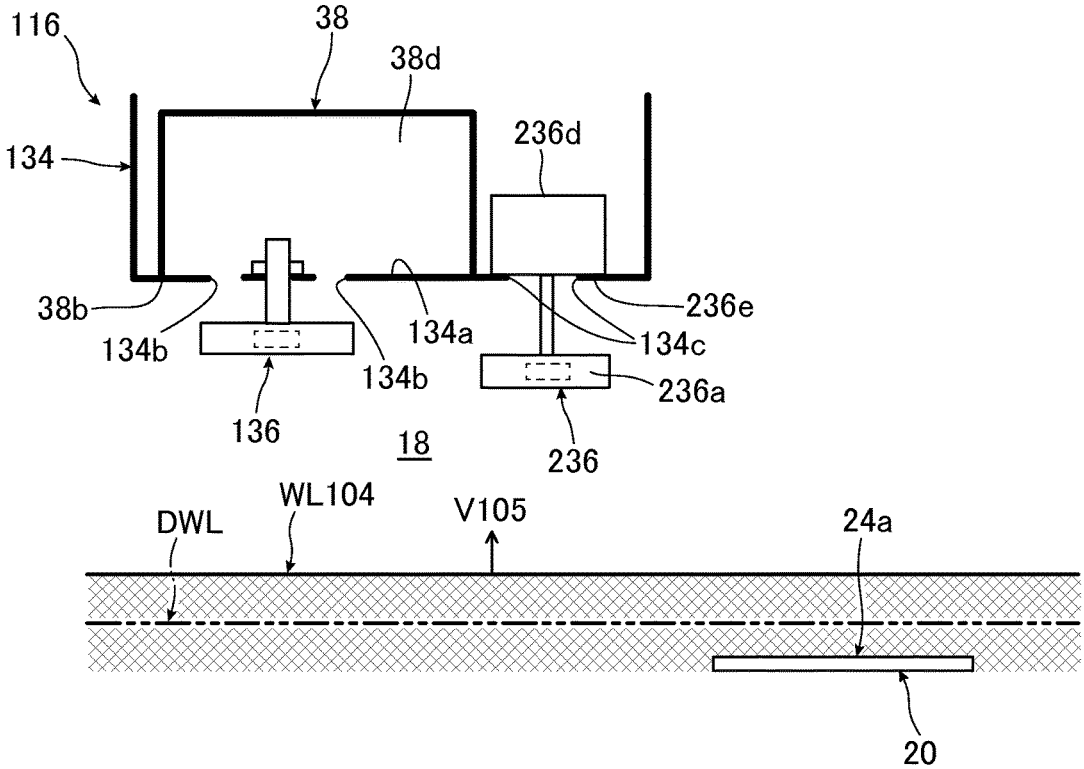
FIG. 10*d* schematically illustrates structures and operations of the float, the first openable and closable valve, and the second openable and closable valve of the flush water supply device in the flush water tank assembly according to the second embodiment of the present invention.

Next, as illustrated in FIG. 10*d*, when all flush water within the small tank 134 has been drained from the first opening 134*b* and the second opening 134*c* into the water storage tank 18, and the small tank 134 becomes in an empty state, the float 38 and the auxiliary float element 236*d* of the second openable and closable valve 236 are rapidly moved downwardly by completely losing their buoyancy based on flush water in the small tank 134, and the lower end 38*b* of the float 38 becomes in contact with the bottom wall 134*a* of the small tank 134.

Further, whole of the second openable and closable valve 236 is moved downwardly, and the lower end 236*e* of the auxiliary float element 236*d* thereof is brought into contact with the upper edge of the second opening 134*c* of the small tank 134, so that whole of the second openable and closable valve 236 becomes hanging from the second opening 134*c* of the small tank 134. In this state, water supply from the flush water supply device 22 to the water storage tank 18 is continued, so that flush water within the water storage tank 18 is raised to a water level WL104 at a position lower than the height position of the lower surface of the buoyancy generating portion 236*a* of the second openable and closable valve 236 at a speed V105. Further, the speed V105 of rising of the water level WL104 in the water storage tank 18 becomes slower than the speed V104 of rising of the water level WL103 in the water storage tank 18 as illustrated in FIG. 10*c* due to the absence of flush water drainable from the first opening 134*b* and the second opening 134*c* of the small tank 134 into the water storage tank 18.

Furthermore, as illustrated in FIG. 10*d*, when the small tank 134 is in an empty state, the float 38 is moved to its lowermost position. In this state, air is reversibly replaceable between the internal space of the buoyancy generating portion 38*b* and a space outside the float 38 via e.g., a gap between the lower end 38*c* of the float 38 and the bottom wall 134*a* of the small tank 134.

Figure 10E:
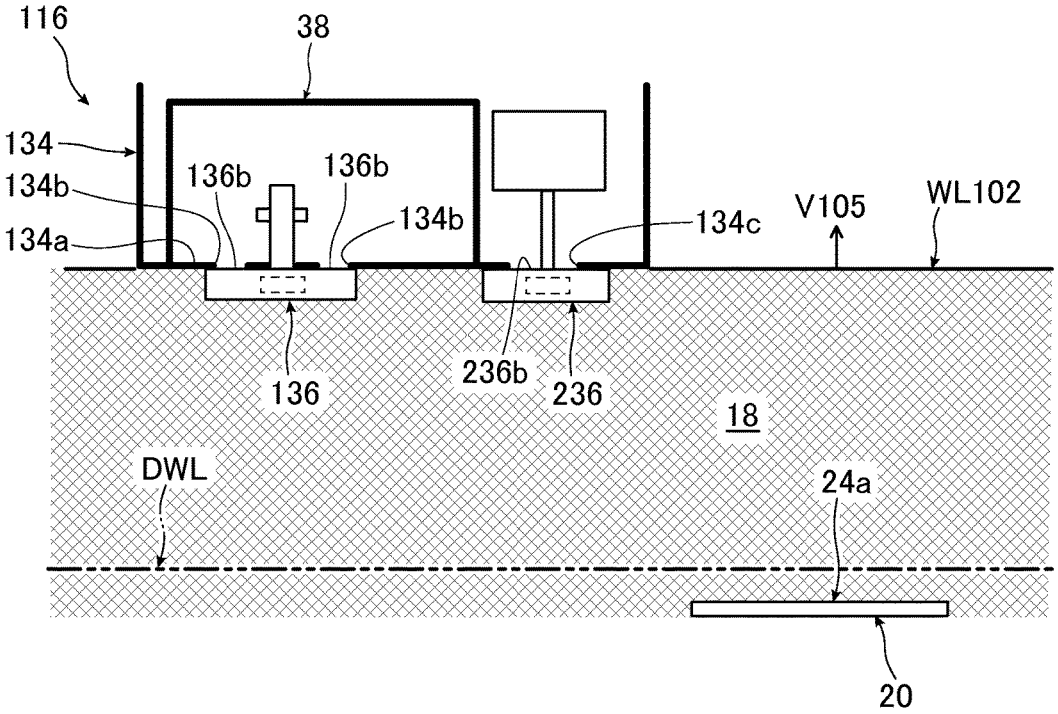
FIG. 10*e* schematically illustrates structures and operations of the float, the first openable and closable valve, and the second openable and closable valve of the flush water supply device in the flush water tank assembly according to the second embodiment of the present invention.

Subsequently, as illustrated in FIG. 10*e*, when water supply from the flush water supply device 22 to the water storage tank 18 is continued, and the water level within the water storage tank 18 is raised to the water level WL102 near the bottom wall 134*a* of the small tank 134, both of the first openable and closable valve 136 and the second openable and closable valve 236 are also moved upwardly, and each valve portion 136*b*, 236*b* is brought into contact with the lower edge of respective opening 134*b*, 134*c* of the small tank 134, so that each opening 134*b*, 134*c* of the small tank 134 is closed by respective openable and closable valve 136, 236. In this state, the small tank 134 remains in an empty state, and the float 38 is moved downwardly to its lowermost position, so that the water supply valve 32 remains opened.

Figure 10F:
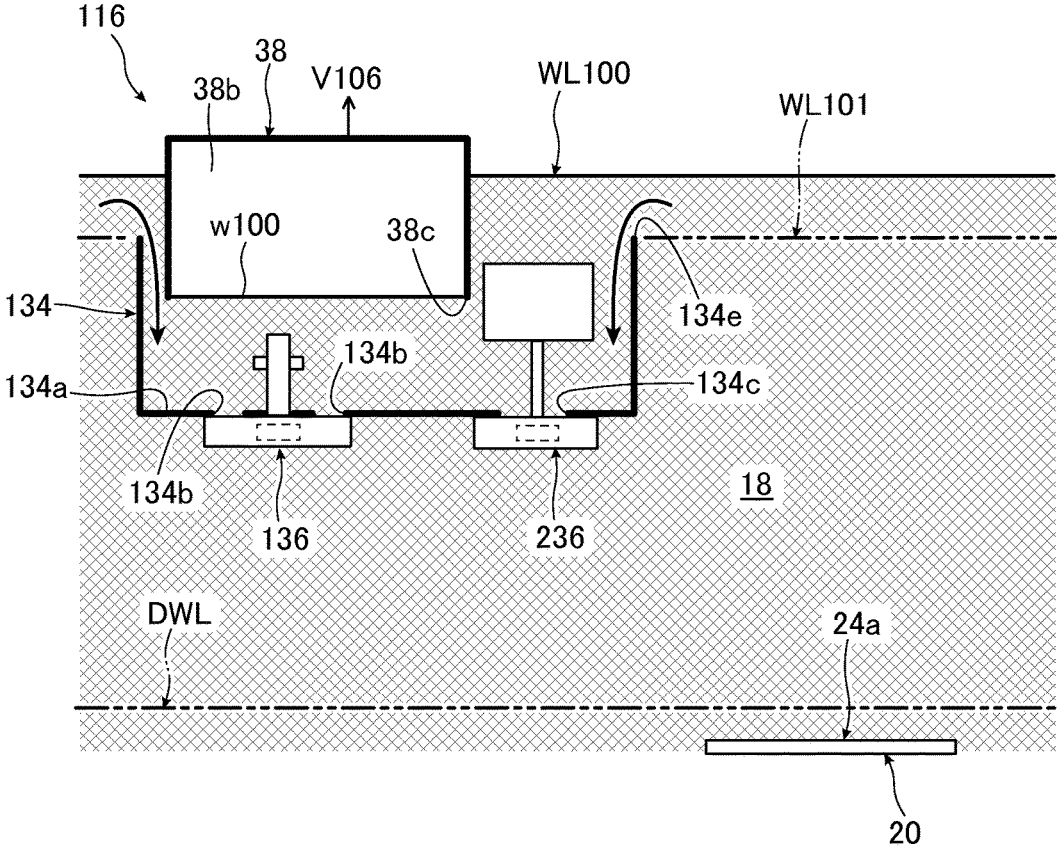
FIG. 10*f* schematically illustrates structures and operations of the float, the first openable and closable valve, and the second openable and closable valve of the flush water supply device in the flush water tank assembly according to the second embodiment of the present invention.

Then, as illustrated in FIG. 10*f*, when the water level in the water storage tank 18 is raised to a position higher than the position of the upper edge 134*e* of the small tank 134, flush water within the water storage tank 18 flows into the small tank 134 beyond the upper edge 134*e* of the small tank 134. As a result, the water level within the small tank 134 is raised rapidly and fills up the small tank 134. In this state, the buoyancy generating portion 38*b* of the float 38 is filled with sufficient air that was previously replaced with the outside air when it was in the state illustrated in FIG. 10*d*. Thus, the float 38 is rapidly moved upwardly to its uppermost position at a speed V106 that is faster than the speed V105 of rising of the water level in the water storage tank 18. This causes the water supply valve 32 to be promptly closed to stop the water supply from the flush water supply device 22 to the water storage tank 18.

As illustrated in FIG. 10*f*, although air is held in the internal space (buoyancy generating portion 38*b*) of the float 38, and the flush water in the small tank 134 scarcely flows into the internal space of the float 38, the water level w100 within the small tank 134 is located slightly above the lower end 38*c* of the float 38 due to a pressure of flush water around the lower end 38*c* of the float 38.

Further, each openable and closable valve 136, 236 is also maintained in a state at the uppermost position by means of buoyancy generated at each buoyancy generating portion 136*a*, 236*a* and each valve portion 136*b*, 236*b* based on flush water within the water storage tank 18 and of buoyancy generated at each auxiliary float element 136*d*, 236*d* based on flush water within the small tank 134. Thus, each opening 134*b*, 134*c* of the small tank 34 is closed by each valve portion 136*b*, 236*b* of respective openable and closable valve 136, 236.

Eventually, the water level within the water storage tank 18 becomes equal to the maximum water level WL100 as illustrated in FIG. 10*f*, and a series of operations in the full flushing mode performed by the flush water tank assembly 116 of the second embodiment is completed.

In the flush water tank assembly 116 according to the second embodiment of the present invention, the second opening 134*c* of the small tank 134, the second openable and closable valve 236, and the auxiliary float element 236*d* provided on the second openable and closable valve 236 are employed as drainable water increasing means capable of increasing a flow rate of flush water drainable from the opening 134*b* of the small tank 134 into the water storage tank 18. The second openable and closable valve 236 includes a valve portion 236*b* for opening and closing the second opening 134*c*, the support portion 236*c* extending upwardly from the valve portion 236*b* and insertable into the second opening 134*c*, and the auxiliary float element 236*d* provided at the upper end of the support portion 236*c*. Each of the first openable and closable valve 136 and the second openable and closable valve 236 is moved upwardly and downwardly to open and close respective opening 134*b*, 134*c*, thereby to change the total opening area (S100+S200) of the first opening 134*b* and the second opening 134*c* of the small tank 134. This makes it possible to facilitate change in flow rate of flush water drainable from the first opening 134*b* and the second opening 134*c* of the small tank 34 into the water storage tank 18. In particular, from when the water discharge port 20 of the water storage tank 18 is opened by the valve element 24*a* of the water discharge valve device 24 until when the water discharge port 20 is closed, the first openable and closable valve 136 and the second openable and closable valve 236 are in either of the following two states: where each of the first openable and closable valve 136 and the second openable and closable valve 236 closes the first opening 134*b* and the second opening 134*c* respectively based on flush water in the water storage tank 18; or where the first openable and closable valve 136 closes the first opening 134*b* based on flush water in the water storage tank 18, and buoyancy is generated at the auxiliary float element 236*d* of the second openable and closable valve 236 based on flush water in the small tank 134 to cause the second openable and closable valve 236 to close the second opening 134*c*. Thus, flush water in the small tank 134 is drained into the water storage tank 18 only from the first opening 134*b* opened by the first openable and closable valve 136 through a relatively small opening area S100. Therefore, the speed of lowering of the water level within the small tank 134 and of the auxiliary float element 236*d* of the second openable and closable valve 236 can be made relatively slow. Thus, it becomes possible to reduce wasteful water that is supplied from the flush water supply device 22 into the water storage tank 18 and discharged to the toilet main unit 2 together with flush water preliminarily stored in the water storage tank 18 (so-called "tail flushing water") with a simple structure, from when the water discharge port 20 of the water storage tank 18 is opened by the valve element 24*a* of the water discharge valve device 24 until when the water discharge port 20 is closed.

Thereafter, as illustrated in FIG. 10*c*, after the water level within the small tank 134 passes through the position of water level w101 after the water discharge port 20 of the water storage tank 18 is closed by the valve element 24*a* of the water discharge valve device 24, buoyancy is generated at the auxiliary float element 236*d* of the second openable and closable valve 236 based on flush water in the small tank 134. In this state, flush water in the small tank 134 is drained into the water storage tank 18 from both of the first opening 134*b* opened by the first openable and closable valve 136 and the second opening 134*c* opened by the second openable and closable valve 236 through a relatively large opening area (S100+S200). Thus, a speed of lowering of water level in the small tank 134, and of the float 38 and the auxiliary float element 236*d* of the second openable and closable valve 236 can be increased, so that flush water within the small tank 134 can be drained in a short period of time to achieve an empty state of the small tank 134. Consequently, air can be reversibly replaced between the internal space for generating buoyancy of the float 38 (buoyancy generating portion 38*b*) and a space outside the float 38, so that when flush water is subsequently supplied to inside the small tank 134 to cause the float 38 to be moved upwardly to perform water stopping operation of the water supply valve 32, buoyancy can be generated so as to normally operate the float 38.

As a result, even if an amount of flush water to be stored in the water storage tank 18 and supplied to the toilet main unit 2 is reduced according to the need for water-saving, it becomes possible to reduce the tail flushing water and replace the air inside the float 38 to operate the float 38 in a normal way.

The invention claimed is:

1. A flush water tank assembly for supplying flush water to a toilet main unit, comprising:

a flush water tank storing therein flush water to be supplied to the toilet main unit and having a water discharge port provided in a bottom wall thereof;

a water supply unit which comprises a water supply pipe having an upstream end connected to a water supply source outside the flush water tank, and a water supply valve for switching between a water supplying state and a water stopping state with respect of an inside of the flush water tank, in terms of flush water supplied from the water supply pipe;

a water compartment attached to the water supply unit and configured to hold therein flush water;

an openable and closable valve for opening and closing an opening formed in a lateral wall or a bottom wall of the water compartment;

a float provided inside the water compartment in such a manner to define therein an internal space for generating buoyancy and become movable upwardly and downwardly according to change in water level within the water compartment, and configured such that, when the water compartment is in an empty state, air is reversibly replaceable between the internal space and a space outside the float;

a swingable member having one end connected to the float and the other end connected to the water supply valve of the water supply unit, the swingable member being configured to open and close the water supply valve according to the upward and downward movements of the float;

a water discharge valve provided to operatively open and close the water discharge port of the flush water tank, in such a manner as to, when it opens the water discharge port, cause flush water in the flush water tank to be discharged to the toilet main unit, and, when it closes the water discharge port, cause flush water to be stored in the flush water tank; and drainable water increasing means including an auxiliary float element configured to be moved upwardly and downwardly according to change in water level within the water compartment to thereby cause the openable and closable valve to be opened and closed, wherein the drainable water increasing means, after the water level within the water compartment passes through a water level position at a time when or after the water discharge valve closes the water discharge port, increases a speed of lowering of the water level within the water compartment to thereby increase a flow rate of flush water drainable from the opening of the water compartment into the flush water tank.

2. The flush water tank assembly as defined in claim 1, wherein the drainable water increasing means is capable of causing an opening area of the opening of the water compartment in a course of opening or closing the opening by the openable and closable valve to be changed to thereby increase the flow rate of flush water drainable from the opening of the water compartment into the flush water tank.

3. The flush water tank assembly as defined in claim 2, wherein the opening of the water compartment is a single opening formed in the bottom wall of the water compartment, and wherein the drainable water increasing means includes the single opening in the bottom wall of the water compartment, the openable and closable valve configured to open and close the single opening, and the auxiliary float element provided on the openable and closable valve, and wherein the openable and closable valve includes: a buoyancy generating portion for generating buoyancy based on flush water in the flush water tank; a valve portion for opening and closing the single opening; and a support portion extending upwardly from the valve portion and having an upper end provided with the auxiliary float element, the support portion having a large diameter segment extending upwardly from the valve portion and insertable into the single opening, and a small diameter segment extending upwardly from the large diameter segment and insertable into the single opening, the small diameter segment having a cross-section less than that of the large diameter segment, whereby the opening area of the single opening is changed when the large diameter segment and the small diameter segment of the support portion are moved upwardly and downwardly.

4. The flush water tank assembly as defined in claim 2, wherein: the opening of the water compartment includes a first opening formed in a lateral wall or a bottom wall of the water compartment, and a second opening formed in the bottom wall of the water compartment, in addition to the first opening; the openable and closable valve includes a first openable and closable valve for opening and closing the first opening, and a second openable and closable valve for opening and closing the second opening, and the drainable water increasing means includes the second opening, the second openable and closable valve, and the auxiliary float element provided on the second openable and closable valve, and wherein the second openable and closable valve includes a valve portion for opening and closing the second opening, and a support portion extending upwardly from the valve portion and insertable into the second opening, and wherein the auxiliary float element is provided on an upper end of the support portion, the auxiliary float element being configured such that, after the water level within the water compartment passes through a water level position at a time when or after the water discharge valve closes the water discharge port, it is lowered by losing its buoyancy.

5. A flush toilet comprising the flush water tank assembly as defined in claim 1.

* * * * *